US009084301B2

(12) United States Patent
Baba

(10) Patent No.: US 9,084,301 B2
(45) Date of Patent: Jul. 14, 2015

(54) ELECTROMAGNETIC INDUCTION HEATING DEVICE, FIXING DEVICE AND IMAGE FORMING APPARATUS USING THE SAME

(75) Inventor: Motofumi Baba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 753 days.

(21) Appl. No.: 12/614,714

(22) Filed: Nov. 9, 2009

(65) Prior Publication Data

US 2010/0322682 A1 Dec. 23, 2010

(30) Foreign Application Priority Data

Jun. 22, 2009 (JP) ..... P2009-147756

(51) Int. Cl.
*H05B 6/14* (2006.01)
*G03G 15/20* (2006.01)

(52) U.S. Cl.
CPC ..... *H05B 6/145* (2013.01); *G03G 15/2042* (2013.01)

(58) Field of Classification Search
CPC ..... H05B 6/145; G03G 15/2042
USPC ..... 399/67, 69, 122, 320, 328, 329, 335, 399/336
See application file for complete search history.

(56) References Cited

U.S. PATENT DOCUMENTS

2004/0188422 A1* 9/2004 Wasai et al. ..... 219/619
2007/0014601 A1* 1/2007 Yasuda et al. ..... 399/329
2008/0124111 A1* 5/2008 Baba et al. ..... 399/69
2008/0226324 A1 9/2008 Baba et al.
2010/0215390 A1 8/2010 Tomita et al.
2011/0318075 A1* 12/2011 Tanda ..... 399/329
2012/0308278 A1* 12/2012 Kikuchi et al. ..... 399/329
2014/0037308 A1* 2/2014 Nawa et al. ..... 399/45

FOREIGN PATENT DOCUMENTS

JP 11-288190 10/1999
JP 2000-030850 1/2000

(Continued)

OTHER PUBLICATIONS

Japanese Office Action dated Jan. 10, 2012 for corresponding application No. 2009-147756.

*Primary Examiner* — Walter L Lindsay, Jr.
*Assistant Examiner* — Jessica L Eley
(74) *Attorney, Agent, or Firm* — Morgan, Lewis & Bockius LLP

(57) ABSTRACT

An electromagnetic induction heating device includes a heat generation body, a heating rotary body, a magnetic filed generating unit and a magnetic path forming member. The heat generation body generates heat through electromagnetic induction. The heating rotary body receives the heat and rotates. The magnetic field generating unit is opposed to the heating rotary body and generates a magnetic field for causing the heat generation body to produce heat through the electromagnetic induction. The magnetic path forming member is opposed to the magnetic filed generating unit across the heating rotary body. The magnetic path forming member includes controlling portions and a continuous portion. The controlling portions control a magnitude of eddy current which is generated through the electromagnetic induction. The continuous portion allows heat transfer along a direction of an axis of the heating rotary body. The continuous portion is opposed to an aperture portion or an end portion of the magnetic field generating unit.

19 Claims, 22 Drawing Sheets

(56) References Cited

FOREIGN PATENT DOCUMENTS

| | | | |
|---|---|---|---|
| JP | 3527442 | B | 2/2004 |
| JP | 2005-285639 | A1 | 10/2005 |
| JP | 2008-152247 | | 7/2008 |
| JP | 2008-234837 | | 10/2008 |
| JP | 2010-197676 | | 9/2010 |
| JP | 2010-224342 | | 10/2010 |
| JP | 2010-224370 | | 10/2010 |
| JP | 2010-230820 | | 10/2010 |

* cited by examiner

Effects of chromium on $\alpha$, $\gamma$ and the Curie points of Fe - Ni

Initial

Continuous operation

Initial

Continuous operation

ELECTROMAGNETIC INDUCTION HEATING DEVICE, FIXING DEVICE AND IMAGE FORMING APPARATUS USING THE SAME

CROSS-REFERENCE TO RELATED APPLICATIONS

This application is based on and claims priority under 35 USC 119 from Japanese Patent Application No. 2009-147756 filed Jun. 22, 2009.

BACKGROUND

Technical Field

The invention relates to an electromagnetic induction heating device, and a fixing device and an image forming apparatus using it.

SUMMARY

According to an aspect of the invention, an electromagnetic induction heating device includes a heat generation body, a heating rotary body, a magnetic field generating unit and a magnetic path forming member. The heat generation body generates heat through electromagnetic induction. The heating rotary body receives the heat from the heat generation body and rotates. The magnetic field generating unit is disposed so as to be opposed to the heating rotary body and generates a magnetic field for causing the heat generation body to produce heat through the electromagnetic induction. The magnetic path forming member is disposed so as to be opposed to the magnetic filed generating unit across the heating rotary body and is made of a temperature-sensitive magnetic material. The magnetic path forming member includes controlling portions and a continuous portion. The controlling portions control a magnitude of eddy current which is generated through the electromagnetic induction caused by the magnetic field generating unit. The continuous portion allows heat transfer along a direction of an axis of the heating rotary body. The continuous portion is opposed to an aperture portion or an end portion of the magnetic field generating unit.

BRIEF DESCRIPTION OF THE DRAWINGS

Exemplary embodiments of the invention will be described in detail with reference to the accompanying drawings, wherein.

DETAILED DESCRIPTION

Exemplary embodiments of the invention will be hereinafter described with reference to the drawings.

Exemplary Embodiment 1

Figure 2:
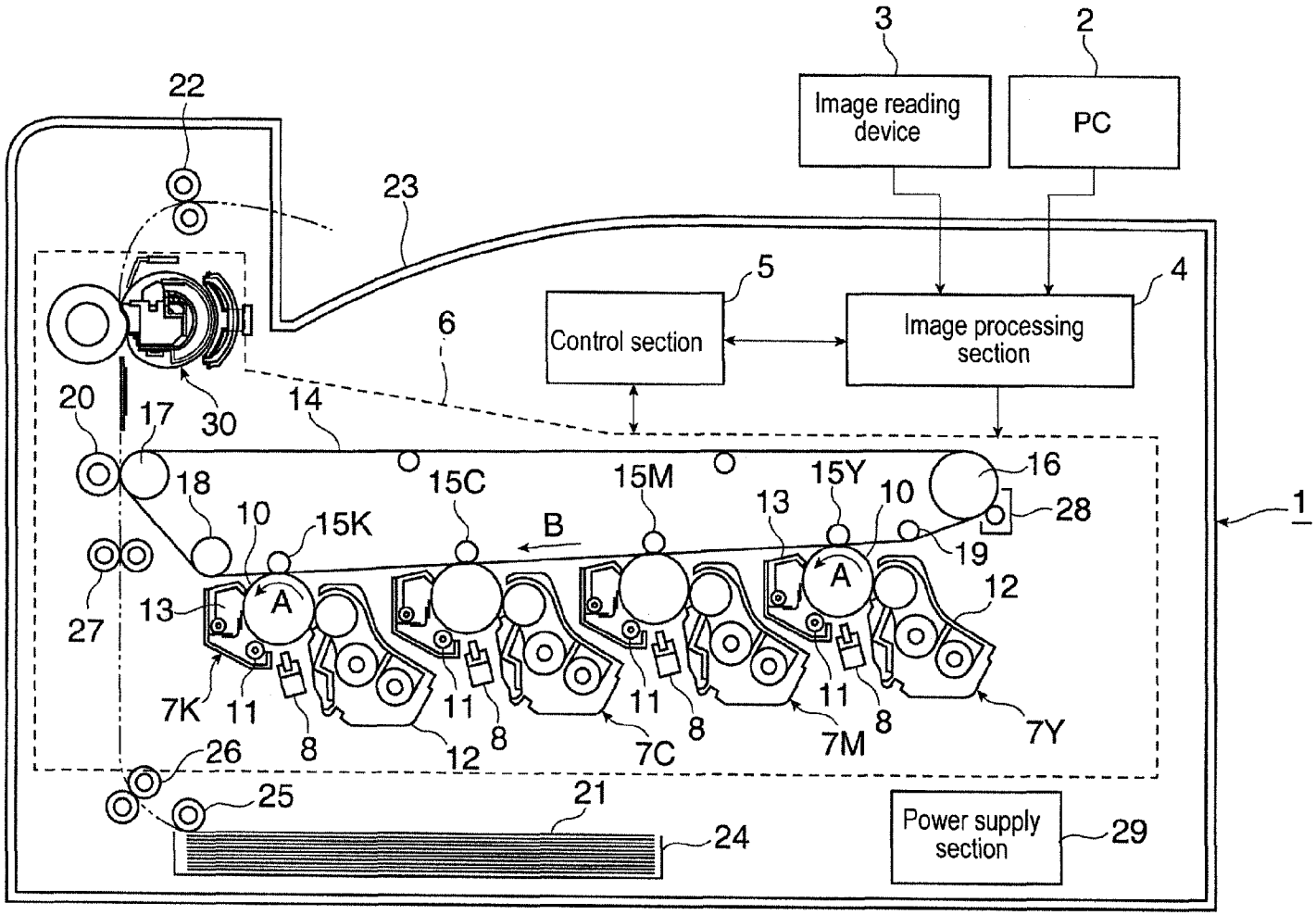
FIG. 2 shows the configuration of a color image forming apparatus which is an image forming apparatus to which the fixing device according to the first exemplary embodiment of the invention is applied.

FIG. 2 shows a color image forming apparatus which is an image forming apparatus to which a fixing device using an electromagnetic induction heating device according to a first exemplary embodiment of the invention is applied. The color image forming apparatus 1 is configured so as to function not only as a printer for printing image data that is sent from a personal computer (PC) 2 but also as a copier for copying the image of a document (not shown) that is read by an image reading device 3 and a facsimile machine for sending and receiving image information.

As shown in FIG. 2, the color image forming apparatus 1 is equipped inside with an image processing section 4 for performing, when necessary, on image data that is sent from the image reading device 3, predetermined image processing such as shading correction, positional deviation correction, lightness/color space conversion, gamma correction, frame removal, and color/movement editing and a control section 5 for controlling the operations of the entire color image forming apparatus 1.

Image data produced by the image processing section 4 through the predetermined image processing (described above) is converted into image data of four colors (yellow (Y), magenta (M), cyan (C), and black (K)) also by the image processing section 4, and output as a full-color image or a monochrome image by an image output unit 6 (described later) which is disposed inside the color image forming apparatus 1.

The image data of the four colors (yellow (Y), magenta (M), cyan (C), and black (K)) produced by the image processing section 4 through conversion are supplied to image exposing devices 8 of image forming units 7Y, 7M, 7C, and 7K of the respective colors (yellow (Y), magenta (M), cyan (C), and black (K)). Each of the image exposing devices 8 performs image exposure using light that is emitted from an LED array according to the image data of the corresponding color.

As shown in FIG. 2, inside the color image forming apparatus 1, the four image forming units 7Y, 7M, 7C, and 7K of yellow (Y), magenta (M), cyan (C), and black (K) are arranged in series along a line that is inclined from the horizontal direction by a predetermined angle so that the image forming unit 7Y of yellow (Y) (first color) is highest and the image forming unit 7K of black (K) (last color) is lowest.

Since as described above the four image forming units 7Y, 7M, 7C, and 7K of yellow (Y), magenta (M), cyan (C), and black (K) are arranged along the line that is inclined by the predetermined angle, the distance between the four image forming units 7Y, 7M, 7C, and 7K can be set shorter than in a case that they are arranged in the horizontal direction and hence the size of the color image forming apparatus 1 can be reduced because it is reduced in width.

The four image forming units 7Y, 7M, 7C, and 7K are basically configured in the same manner except for the color of an image formed. As shown in FIG. 2, each of the image forming units 7Y, 7M, 7C, and 7K is generally composed of a photoreceptor drum 10 as an image carrying body which is rotationally driven by a driving device (not shown) so as to rotate at a predetermined speed in the direction indicated by arrow A, a charging roll 11 for primary charging for charging the surface of the photoreceptor drum 10 uniformly, an image exposing device 8 (LED print head) for forming, through exposure, an electrostatic latent image corresponding to the predetermined color on the surface of the photoreceptor drum 10, a developing device 12 for developing the electrostatic latent image formed on the photoreceptor drum 10 with toner of the predetermined color, and a cleaning device 13 for cleaning the surface of the photoreceptor drum 10.

For example, the photoreceptor drum 10 is a 30-mm-diameter drum-shaped body whose surface is coated with an organic photoconductor (OPC). The photoreceptor drum 10 is rotated is rotationally driven by the drive motor (not shown) so as to rotate at the predetermined speed in the direction indicated by arrow A.

For example, the charging roll 11 is a roll-shaped charger in which the surface of a core metal member is coated with a conductive layer which is made of a synthetic resin or a rubber and whose electric resistance is adjusted. A predetermined charging bias is applied to the core metal member of the charging roll 11.

As shown in FIG. 2, the image exposing devices 8 are disposed in the four respective image forming units 7Y, 7M, 7C, and 7K. Each image exposing device 8 is equipped with an LED array in which LEDs are arranged straightly parallel with the axial direction of the photoreceptor drum 10 at a predetermined pitch (e.g., 600 to 2,400 dpi) and a SELFOC lens (trade name) array for forming, on the photoreceptor drum 10, a spot of light emitted from each LED of the LED array. As shown in FIG. 2, each image exposing device 8 is configured so as to form an electrostatic latent image on the photoreceptor drum 10 by scanning and exposing its surface from below.

Each image exposing device 8 is not limited to the one using the LED array, and may naturally be one that scans the surface of the photoreceptor drum 10 by deflecting a laser beam in a direction that is parallel with the axial direction of the photoreceptor drum 10. In the latter case, a single image exposing device 8 may be provided for the four image forming units 7Y, 7M, 7C, and 7K.

Image data of the four colors that correspond to the image exposing devices 8Y, 8M, 8C, and 8K which are provided in the image forming units 7Y, 7M, 7C, and 7K of yellow (Y), magenta (M), cyan (C), and black (K), respectively, are output sequentially from the image processing section 4. The surfaces of the photoreceptor drums 10 are scanned with and exposed to light beams that are emitted from the image exposing devices 8Y, 8M, 8C, and 8K according to the image data, respectively, whereby electrostatic latent images are formed according to the respective image data. The electrostatic latent images formed on the photoreceptor drums 10 are developed into toner images of yellow (Y), magenta (M), cyan (C), and black (K) by the developing devices 12Y, 12M, 12C, and 12K, respectively.

The toner images of yellow (Y), magenta (M), cyan (C), and black (K) which are sequentially formed on the photoreceptor drums 10 of the image forming units 7Y, 7M, 7C, and 7K are primarily transferred sequentially and in a multiple manner by four primary transfer rolls 15Y, 15M, 15C, and 15K to an intermediate transfer belt 14 which is an endless-belt-shaped intermediate transfer member disposed over the image forming units 7Y, 7M, 7C, and 7K so as to be inclined from the horizontal direction.

The intermediate transfer belt 14 is an endless-belt-shaped member suspended by plural rolls and is disposed so as to be inclined from the horizontal direction so that its downstream side is lower and its upstream side is higher.

More specifically, as shown in FIG. 2, the intermediate transfer belt 14 is wound on a drive roll 16, a back support roll 17, a tension applying roll 18, and a follower roll 19 with certain tension, and is circulated in the direction indicated by arrow B at a predetermined speed by the drive roll 16 which is rotationally driven by a drive motor (not shown) which is superior in the ability to maintain a constant speed. For example, the intermediate transfer belt 14 is formed by forming a band of a flexible synthetic resin film of polyimide, polyamide-imide, or the like and connecting its both ends by welding or the like or forming an endless belt directly using the same film The intermediate transfer belt 14 is disposed so that its bottom part is in contact with the photoreceptor drums 10Y, 10M, 10C, and 10K of the image forming units 7Y, 7M, 7C, and 7K as it runs.

As shown in FIG. 2, a secondary transfer roll 20 as a secondary transfer unit for secondarily transferring, to a recording medium 21, the toner images which have been primarily transferred to the intermediate transfer belt 14 is disposed so as to be in contact with the surface of that portion (the lower end portion of the top part) of the intermediate transfer belt 14 which is wound on the back support roll 17.

As shown in FIG. 2, the toner images of yellow (Y), magenta (M), cyan (C), and black (K) that have been transferred to the intermediate transfer belt 14 in a multiple manner are secondarily transferred to the recording sheet 21 (recording medium) by electrostatic force by the secondary transfer roll 20 which is pressed against the back support roll 17 with the intermediate transfer belt 14 interposed in between. The recording sheet 21 to which the toner images of the respective colors have been transferred is conveyed to a fixing device according to the exemplary embodiment. Pressed against the side portion of the back support roll 17 with the intermediate transfer belt 14 interposed in between, the secondary transfer roll 20 secondarily transfers the toner images of the respective colors together to the recording sheet 21 which is being conveyed upward in the vertical direction.

For example, the secondary transfer roll 20 is such that the outer circumferential surface of a core metal member made of stainless steel or the like is coated, at a predetermined thickness, with an elastic layer made of a conductive elastic material such as a rubber material added with a conductive agent.

The recording sheet 21 to which the toner images of the respective colors have been transferred is subjected to fixing processing (heat and pressure are applied to it) in the fixing device 30 according to the exemplary embodiment, and then ejected to an ejection tray 23 which constitutes the top portion of the apparatus 1 by ejection rolls 22 with the image forming surface down.

As shown in FIG. 2, one recording sheet 21 is fed so as to be separated by a sheet feed roll 25 and sheet separation/conveying rolls 26 from recording sheets 21 housed in a sheet supply tray 24 which is located at the bottom of the apparatus 1. The thus-separated sheet 21 is conveyed to registration rolls 27 and stopped there. The sheet 21 which has thus been supplied from the sheet supply tray 24 is sent to the secondary transfer position of the intermediate transfer belt 14 by the registration rolls 27 which rotate with predetermined timing. As the recording sheets 21, not only plain sheets but also thick sheets such as coat sheets each of whose front surface or both surfaces have coatings can be supplied. Photographs etc. can be output to coat sheets.

Residual toners etc. are removed from the surface of the intermediate transfer belt 14 that has been subjected to toner images secondary transfer processing by a belt cleaning device 28 which is located adjacent to the drive roll 16, to prepare for the next image forming operation. In FIG. 2, reference numeral 29 denotes a power supply section for supplying power to the individual sections and units of the color image forming apparatus 1.

Figure 1:
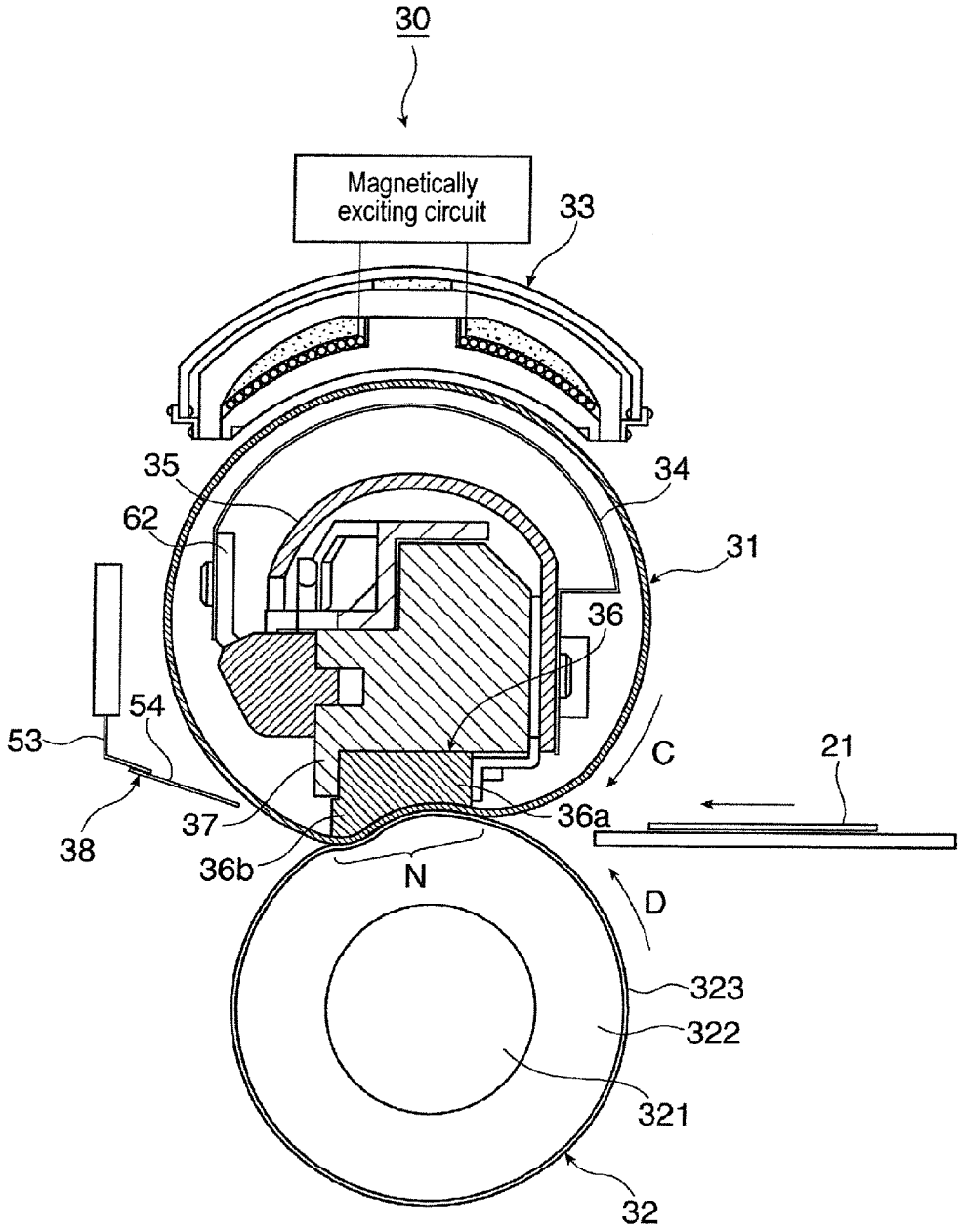
FIG. 1 is a sectional view showing the configuration of a fixing device using an electromagnetic induction heating device according to a first exemplary embodiment of the invention.

FIG. 1 shows the configuration of a fixing device using an electromagnetic induction heating device which is applied to the color image forming apparatus 1 according to the first exemplary embodiment of the invention.

A heating rotary body may be either a belt or a roll and may be integral with or separated from a heat generation body (which will be described later). When the heating rotary body performs heating, the heating rotary body may heat a subject to be heated finally (e.g., a recording medium) either directly or indirectly. In the exemplary embodiment, the heating rotary body is integrated with the heat generation body to constitute a belt, that is, an endless fixing belt 31 which comes into contact with a recording sheet and heats it. As shown in FIG. 1, the fixing device 30 is equipped with the endless fixing belt 31 and an alternating magnetic field generating device 33 (an example of alternating magnetic field generating unit). The endless fixing belt 31 is rotated in the direction indicated by arrow C. The alternating magnetic field generating device 33 is opposed, with a certain gap, to a portion of the outer circumferential surface of the fixing belt 31 which is opposite to a pressure contact region (nip region N) where a pressure application roll 32 (pressing body of the exemplary embodiment) is pressed against the fixing belt 31.

The fixing device 30 is also equipped with a heat generation control member 34 which is an example of a magnetic path forming member of the exemplary embodiment. The magnetic path forming member may be provided on either the inner circumferential surface or the outer circumferential surface as long as it is opposed to the inner circumferential surface or the outer circumferential surface. In this exemplary embodiment, the heat generation control member 34 is disposed inside the fixing belt 31 so as not to be in contact with the fixing belt 31 and to be opposed to the alternating magnetic field generating device 33 across the fixing belt 31. Furthermore, the fixing device 30 is equipped with a non-magnetic metal guide member 35, a pressing member 36, a support member 37 and a peeling assist member 38. The non-magnetic metal guide member 35 guides a magnetic flux that passes through the heat generation control member 34 under a predetermined condition. The pressing member 36 brings the pressure application roll 32 into pressure contact with the fixing belt 31. The support member 37 supports the heat generation control member 34, the non-magnetic metal guide member 35, and the pressing member 36. The peeling assist member 38 assists peeling of a recording sheet 21 from the fixing belt 31.

Figure 3:
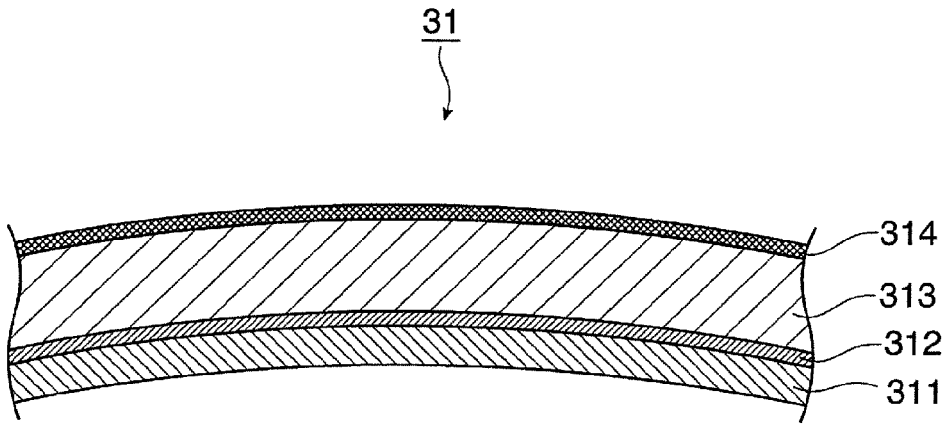
FIG. 3 is a sectional view showing the structure of a fixing belt.

In a state where the fixing belt 31 is not deformed being pressed against the pressure application roll 32, the fixing belt 31 is shaped like a hollow cylinder having a thin wall and is about 20 to 50 mm in outer diameter. In this exemplary embodiment, the outer diameter of the fixing belt 31 is set at 30 mm. For example, as shown in FIG. 3, the fixing belt 31 includes a base layer 311 and a heat generation layer 312 (an example of a heat generation body of the exemplary embodiment), an elastic layer 313, and a surface mold release layer 314 which are stacked on the outer circumferential surface of the base layer 311 in this order. It goes without saying that the layer structure of the fixing belt 31 is not limited to this structure.

In the exemplary embodiment, the base layer 311 serves not only as a base member which gives necessary mechanical strength to the fixing belt 31 but also as a member in which magnetic paths of an alternating magnetic field generated by the alternating magnetic field generating device 33 are formed. However, magnetic paths of the alternating magnetic field generated by the alternating magnetic field generating device 33 need not always be formed in the base layer 311. In the exemplary embodiment, the base layer 311 is made of a temperature-sensitive magnetic material whose permeability depends on the temperature. For example, the base layer 311 is made of a temperature-sensitive ferromagnetic material whose permeability change start temperature (at which permeability starts to change) is set in a predetermined range that is higher than or equal to a heating set temperature of the fixing belt 31 at which toner images of the respective colors are melted and that is lower than a heatproof temperature of the elastic layer 313 or the surface mold release layer 314.

Even more specifically, the base layer 311 is made of a temperature-sensitive magnetic material which makes a transition in a reversible manner between a ferromagnetic state (the relative permeability is several hundred or more) and a paramagnetic state (the relative permeability is approximately equal to 1) in a predetermined temperature range that is higher than or equal to the heating set temperature of the fixing belt 31, for example, in a temperature range between the heating set temperature and a temperature that is higher than it by about 100° C. In the temperature range that is lower than or equal to the permeability change start temperature, the base layer 311 exhibits ferromagnetism and guides a magnetic flux of an alternating magnetic field generated by the alternating magnetic field generating device 33 to form, inside the base layer 311, magnetic paths that extend parallel with the surface of the base layer 311. In the temperature range that is higher than the permeability change start temperature, the base layer 311 exhibits paramagnetism and a magnetic flux generated by the alternating magnetic field generating device 33 passes through the base layer 311 in its thickness direction.

Figure 4:
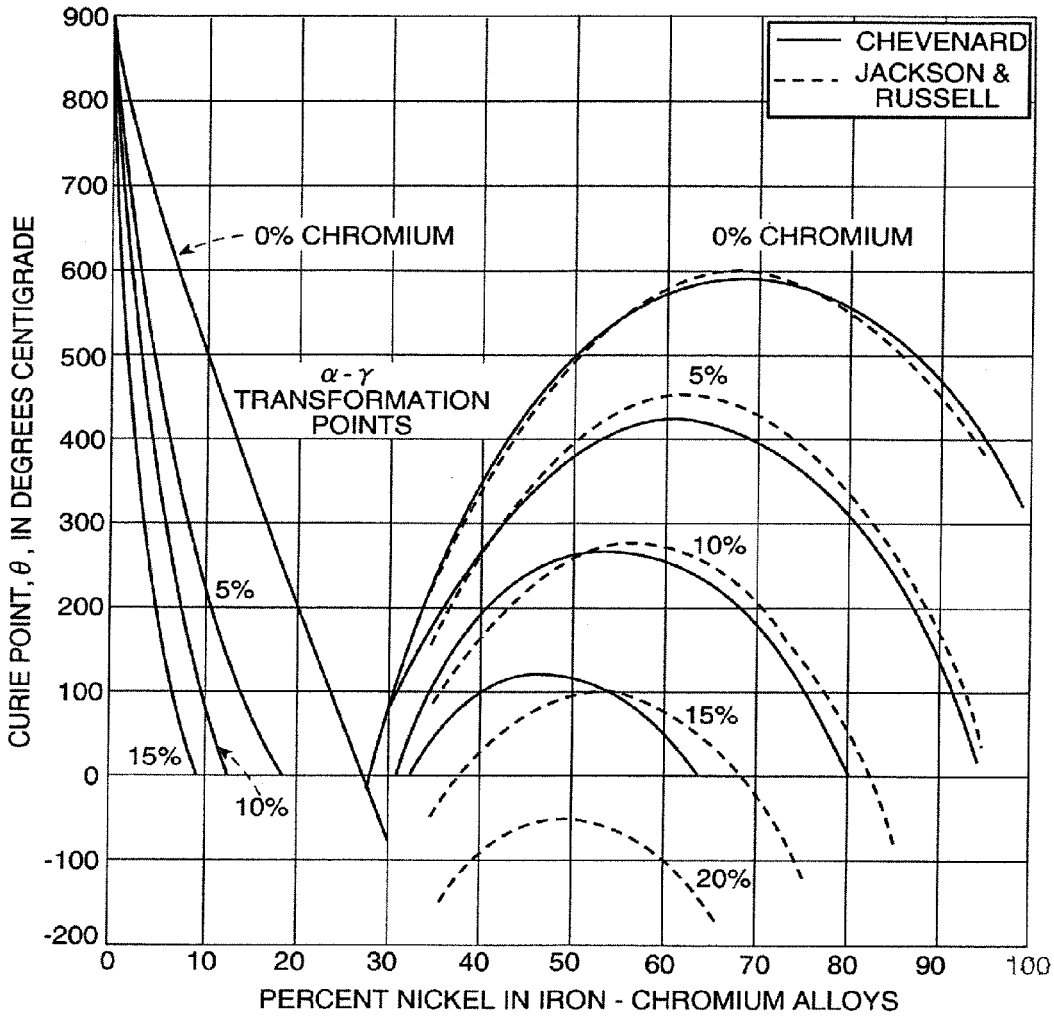
FIG. 4 is a graph showing how the Curie point varies depending on the component ratio of a temperature-sensitive magnetic material.

For example, the base layer 311 is made of a two-component alloy such as an Fe—Ni alloy (for example, permalloy, magnetic compensator alloys flux), a three-component alloy such as an Fe—Ni—Cr alloy, or the like whose permeability change start temperature is set in, for example, a range of 140° C. to 240° C. which is a heating set temperature set range of the fixing belt 31. Metal alloys such as permalloys and magnetic compensator alloys flux are suitable for the base layer 311 of the fixing belt 31 because, for example, they are superior in thin-sheet moldability and workability, high in thermal conductivity, inexpensive, and high in mechanical strength. Other example materials of the base layer 311 are metal alloys made of elements selected from Fe, Ni, Si, B, Nb, Cu, Zr, Co, Cr, V, Mn, Mo, etc. For example, in the case of an Fe—Ni two-component alloy, the permeability change start temperature can be set at about 225° C. by setting the Fe-to-Ni ratio (number-of-atoms ratio) to 64:36 (see FIG. 4). All of these alloys have large resistivity values that are larger than or equal to $60\times10^{-8}$ Ω·m and hence are hard to induction-heat when their thickness is 200 μm or less. In view of this, the exemplary embodiment separately employs the heat generation layer 312 which is easily to induction-heat.

As described below, for example, the base layer 311 is formed so as to have a predetermined thickness which is smaller than a skin depth for an alternating magnetic field (magnetic field lines) generated by the alternating magnetic field generating device 33. More specifically, where an Fe—Ni alloy is used as the material of the base layer 311, its thickness is set at about 20 to 80 μm, for example, 50 μm.

The skin depth δ is known as a parameter indicating a distance at which an alternating magnetic field entering a certain material attenuates to 1/e (≅1/2.718). The skin depth δ is given by the following Equation (1). In Equation (1), f is the frequency (e.g., 20 kHz) of an alternating magnetic field, ρ is the resistivity (Ω·m), and $\mu_r$ is the relative permeability.

$$\delta = 503\sqrt{\frac{\rho}{f\mu_r}} \tag{1}$$

Figure 5:
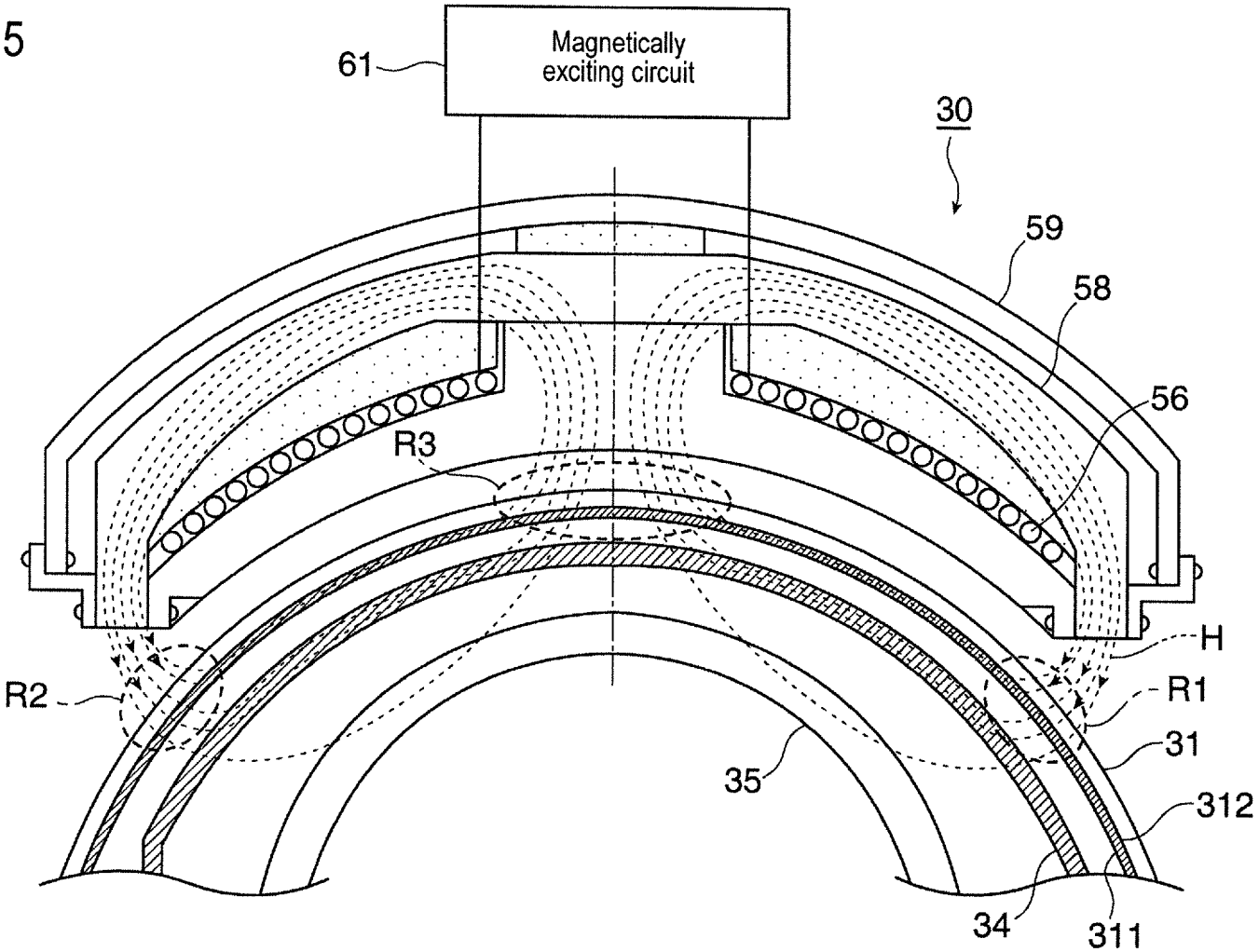
FIG. 5 shows how a magnetic field generated by an alternating magnetic field generating device passes through respective members.

For example, where the base layer 311 of the fixing belt 31 is made of a material whose resistivity ρ is $70\times10^{-8}$ Ω·m and relative permeability $\mu_r$ is 400 and the frequency of an alternating magnetic field is 20 kHz, the skin depth δ of the base layer 311 is calculated as 149 μm according to Equation (1). Therefore, if the base layer 311 of the fixing belt 31 is made as thin as 50 μm to secure necessary mechanical strength of the fixing belt 31 and to increase its flexibility, the thickness of the base layer 311 is smaller than its skin depth 149 μm. As a result, as shown in FIG. 5, parts of an alternating magnetic field (magnetic field lines H) generated by the alternating magnetic field generating device 33 are introduced to inside the base layer 311 of the fixing belt 31 in regions R1, R2, and R3 and forms magnetic paths there. The remaining parts of the alternating magnetic field pass through the base layer 311.

In contrast, since the heat generation control member 34 is disposed on the side of the inner circumferential surface of the fixing belt 31, when the temperature of the fixing belt 31 is at a fixing temperature that is lower than or equal to the permeability change start temperature, closed loops are formed in which the remaining parts of the magnetic field lines H that pass through the base layer 311 go along the heat generation control member 34 and a major magnetic flux passes through the region R3 and returns to a magnetically exciting coil 56 (see FIG. 5). Where such magnetic paths are formed, the degree of magnetic coupling is increased in the regions R1, R2, and R3 and hence the magnetic flux density is increased, whereby a large eddy current I is generated in the conductive layer 312 of the fixing belt 31 and a large Joule heat W is generated in the fixing belt 31.

To suppress direct heat inflow from the fixing belt 31 to be induction-heated at a start of the fixing device 30 and thereby shorten the time the temperature of the fixing belt 31 takes to reach a fixible temperature, the heat generation control member 34 of the exemplary embodiment is disposed so as to be not in contact with the inner circumferential surface.

The conductive layer 312 which is laid on the surface of the base layer 311 functions as an electromagnetic induction heat generation layer which is heated through electromagnetic induction by an alternating magnetic field generated by the alternating magnetic field generating device 33. Non-magnetic metals having relatively small resistivity values such as Ag, Cu, and Al are suitable for the material of the conductive layer 312 because they enable formation of a thin film of about 2 to 30 μm. Incidentally, the resistivity values of Ag, Cu, and Al are $1.59\times10^{-8}$ Ω·m, $1.67\times10^{-8}$ Ω·m, and $2.7\times10^{-8}$ Ω·m, respectively.

For example, in the fixing device 30 according to the exemplary embodiment, a conductive layer 312 which is made of Cu having a high conductivity is formed on the surface of a 50-μm-thick base layer 311 made of an Fe—Ni alloy at a thickness of about 10 μm by rolling, plating, evaporation, or the like. By forming the base layer 311 and the conductive layer 312 as thin layers in the above-described manner, the flexibility of the entire fixing belt 31 is increased and it is given necessary mechanical strength.

As described above, the material of the base layer 311 of the exemplary embodiment is 10 times or more as high in resistivity as that of the conductive layer 312. Therefore, eddy current I flows less easily in the base layer 311 than in the conductive layer 312. As such, the base layer 311 is a non-heat-generation layer whose heat generation amount is well negligible as compared with the heat generation amount of the conductive layer 312. Even if the base layer 311 generates heat, it is absorbed by the fixing belt 31 including the conductive layer 312.

The elastic layer 313 which is laid on the surface of the conductive layer 312 is made of an elastic material such as a silicone rubber. Toner images that are held by a recording sheet 21 (subject of fixing) are a stack of powder toners of plural colors, and the toner total amount is large particularly in the case of a full-color image. Therefore, to melt toner images on a recording sheet 21 by heating them uniformly in the nip region N of the fixing device 30, it is desirable that the surface of the fixing belt 31 be deformed elastically so as to conform to asperities of the toner images. For example, in the exemplary embodiment, the elastic layer 313 is made of a silicone rubber having a thickness of 100 to 600 μm and JIS-A hardness of 10° to 30°.

The surface mold release layer 314 which is laid on the surface of the elastic layer 313 is made of a material that is high in mold releaseability because it is to come into direct contact with toner images that are held on a recording sheet 21. For example, the surface mold release layer 314 is made of PFA (tetrafluoroethylene-perfluoroalkyl vinyl ether copolymer), PTFE (polytetrafluoroethylene), or a silicone copolymer or is a composite layer of layers made of these materials. If the surface mold release layer 314 is too thin, it is insufficient in abrasion resistance and shortens the life of the fixing belt 31. On the other hand, if the surface mold release layer 314 is too thick, it makes the heat capacity of the fixing belt 31 too large and makes the warm-up time unduly long. In view of the above (i.e., to balance the abrasion resistance and the heat capacity), in the exemplary embodiment, the thickness of the surface mold release layer 314 is set in a range of 1 to 50 μm.

Figure 6A:
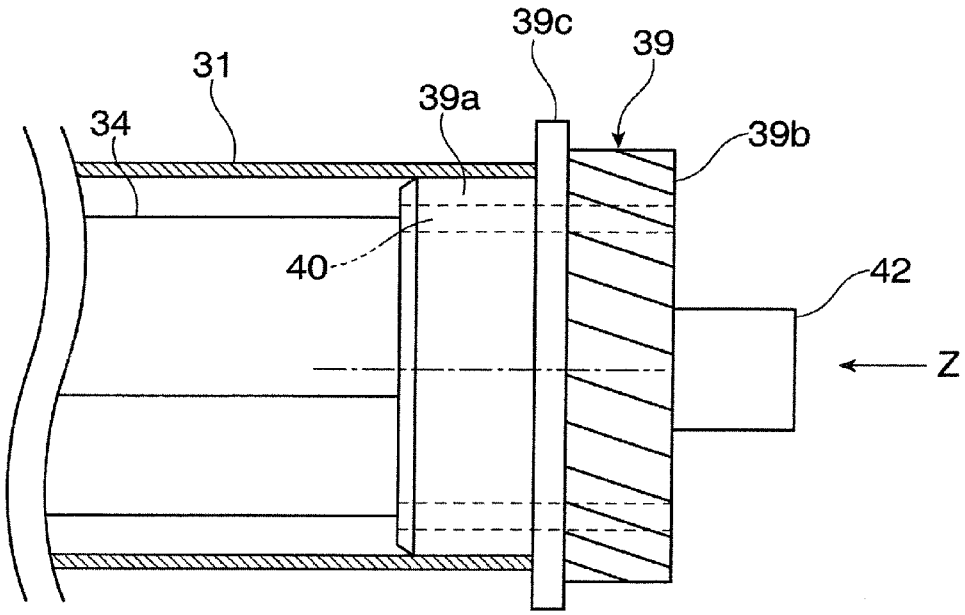
FIGS. 6A and 6B show a structure that supports each end portion of the fixing belt.
Figure 6B:
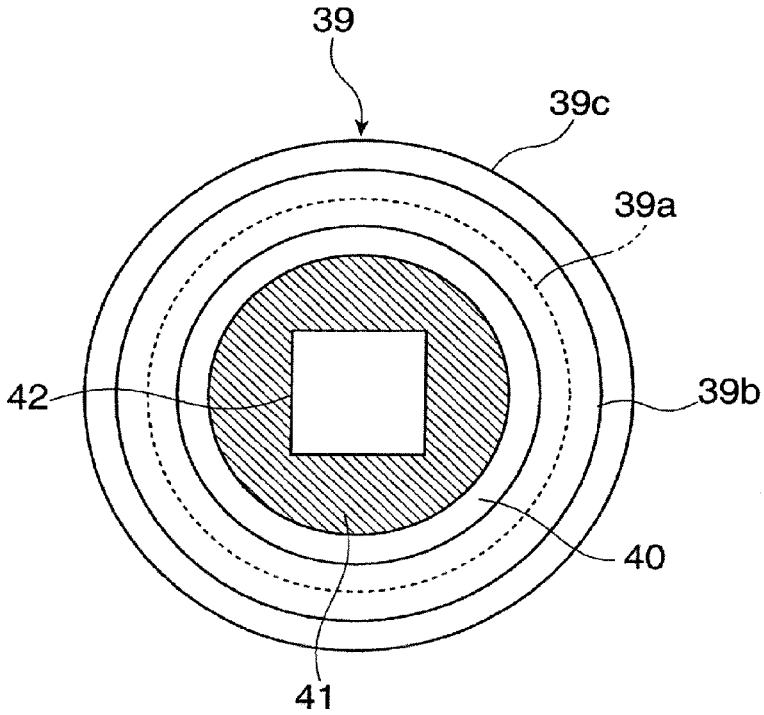

As shown in FIG. 6A, the fixing belt 31 having the above-described structure is mounted in a state that a flange member 39 as a drive force transmitting member for transmitting drive force to rotationally drive the fixing belt 31 is fixed to both end portions, in the longitudinal direction (axial direction), of the fixing belt 31 by press fitting, bonding, or a like method. The flange member 39 is provided with a cylinder portion 39*a* which is inserted in the corresponding end portion of the fixing belt 31, a cylindrical drive portion 39*b* which is greater in wall thickness than the cylinder portion 39*a* and projects to outside the fixing belt 31 in its axial direction and whose outer circumferential surface is formed integrally with the teeth of a helical gear, and an annular flange portion 39*c* which is disposed between the cylinder portion 39*a* and the drive portion 39*b* so as to project outward in the radial direction. As shown in FIG. 6B, the flange member 39 is supported rotatably by a fixing member 41 via a bearing member 40 which is provided on its inner circumferential surface extending from the cylinder portion 39*a* to the drive portion 39*c*. As shown in FIG. 6B, the fixing member 41 is attached to the outer circumferential surface of the support portion 42 which has a rectangular cross section and is formed at both ends, in the longitudinal direction, of the support member 37 so as to project outward.

What is called engineering plastics which are high in mechanical strength and heat resistance, such as a phenol resin, a polyimide resin, a polyamide resin, a polyamide-imide resin, a PEEK resin, a PES resin, a PPS resin, and an LCP resin, are suitable for the material of the flange member 39.

Figure 7:
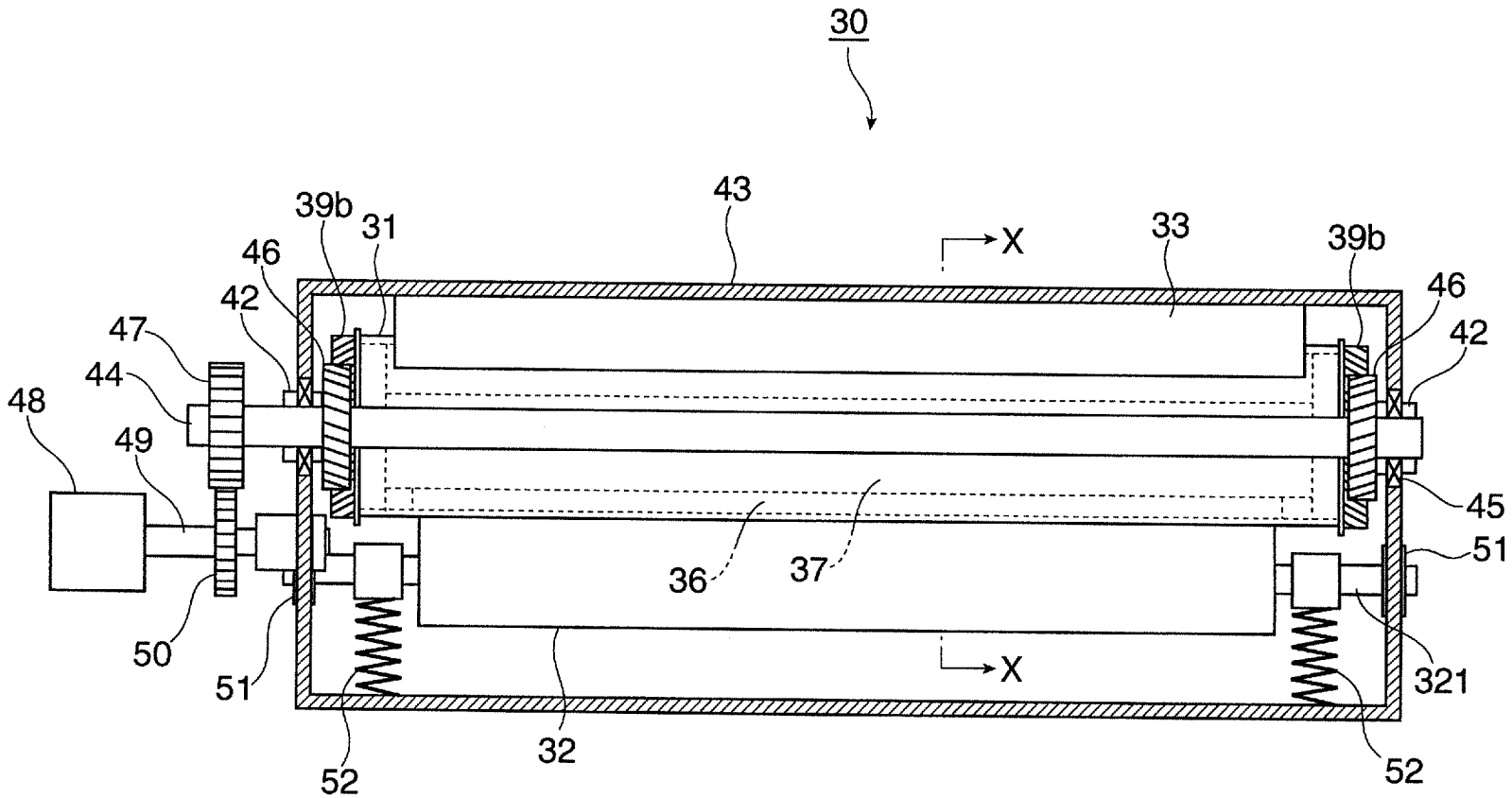
FIG. 7 shows the configuration of the fixing device according to the first exemplary embodiment of the invention.

As shown in FIG. 7, the fixing device 30 is equipped with a frame body 43 which assumes a long and narrow rectangle. Both end portions of a drive shaft 44 for rotationally driving the fixing belt 31 is supported rotatably by the frame body 43 via bearing members 45. Drive gears 46 that are in mesh with the drive portions 39*b* of the flange members 39 which are located at both ends of the fixing belt 31, respectively, are attached to both end portions of the portion, located inside the frame body 43, of the drive shaft 44. A transmission gear 47 for transmitting drive force to the drive shaft 44 is attached to the one end portion, located outside the frame body 43, of the drive shaft 44. A transmission gear 50 which is fixed to a rotary shaft 49 of a drive motor 48 is in mesh with the transmission gear 47. The one end portion of the transmission shaft 49 of the drive motor 48 is attached rotatably to the frame body 43 of the fixing device 30. In the fixing device 30, when the drive motor 48 is driven rotationally, the rotational drive force of the drive motor 48 is transmitted to the drive shaft 44 via the transmission gears 50 and 47 and the drive gears 46 which are attached to the drive shaft 44 are rotated. And the fixing belt 31 is rotationally driven at a predetermined rotation speed (e.g., 140 mm/sec (circumferential speed)) by the drive portions 39*b* (which are in mesh with the respective drive gears 46) of the flange members 39 which are provided at both ends of the fixing belt 41.

Since as described above the fixing belt 31 are the stack of the base layer 311, the heat generation layer 312, the elastic layer 313, and the surface mold release layer 314 which are made of metal materials, synthetic resin materials, etc., it is flexible and mechanically strength. Therefore, it is rotationally driven smoothly without buckling even when receiving rotational drive torque from the drive portions 39*b* (which are in mesh with the respective drive gears 46) of the flange members 39.

As shown in FIG. 7, the support portions 42 of the support member 37 penetrate through and are fixed to the frame body 43 behind the bearing members 45 (as viewed in FIG. 7).

On the other hand, as shown in FIG. 1, the pressure application roll 32 which is in pressure contact with the fixing belt 31 is composed of, for example, a solid, cylindrical metal core member 321 of 18 mm in diameter, a heat-resistant elastic layer 322 which is made of a silicone rubber, a fluorine rubber, or the like and is formed on the outer circumferential surface of the metal core member 321 at a thickness of 5 mm, and a surface mold release layer 323 which is made of PFA or the like and is formed on the surface of the heat-resistant elastic layer 322 at a thickness of 50 μm.

As shown in FIG. 7, both end portions of the metal core member 321 of the pressure application roll 32 are supported rotatably by the frame body 43 of the fixing device 30 via bearing members 51 and are urged by coil springs 52 (a urging member) so that the pressure application roll 32 comes into pressure contact with the fixing belt 31 at a predetermined pressure (e.g., force of 200 kgf). The bearing members 51 which support the pressure application roll 32 rotatably are held by long holes (not shown) so as to be movable in the direction in which the pressure application roll 32 comes into contact with and is detached from the fixing belt 31.

A contact/detachment mechanism (not shown) may be provided which makes the pressure application roll 32 movable in the direction in which the pressure application roll 32 comes into contact with and is detached from the fixing belt 31. In this case, the pressure application roll 32 is moved by the contact/detachment mechanism so as to be separated from the fixing belt 31 during preliminary heating, that is, heating before establishment of a fusible state.

As shown in FIG. 1, the peeling assist member 38 is disposed downstream, in the conveyance direction (indicated by an arrow) of a recording sheet 21, of the nip region N where the fixing belt 31 and the pressure application roll 32 are in pressure contact with each other. The peeling assist member 38 is composed of a support portion 53 whose one end is supported in a fixed manner and a peeling sheet 54 which is supported by the support portion 53. The peeling assist member 38 is disposed so that the tip of the peeling sheet 54 is in close proximity to or in contact with the fixing belt 31. The tip portion of the peeling assist member 38 forcibly peels a recording sheet 21 that has not been peeled off the fixing belt 21 by rigidity of the recording sheet 21 itself.

Figure 8:
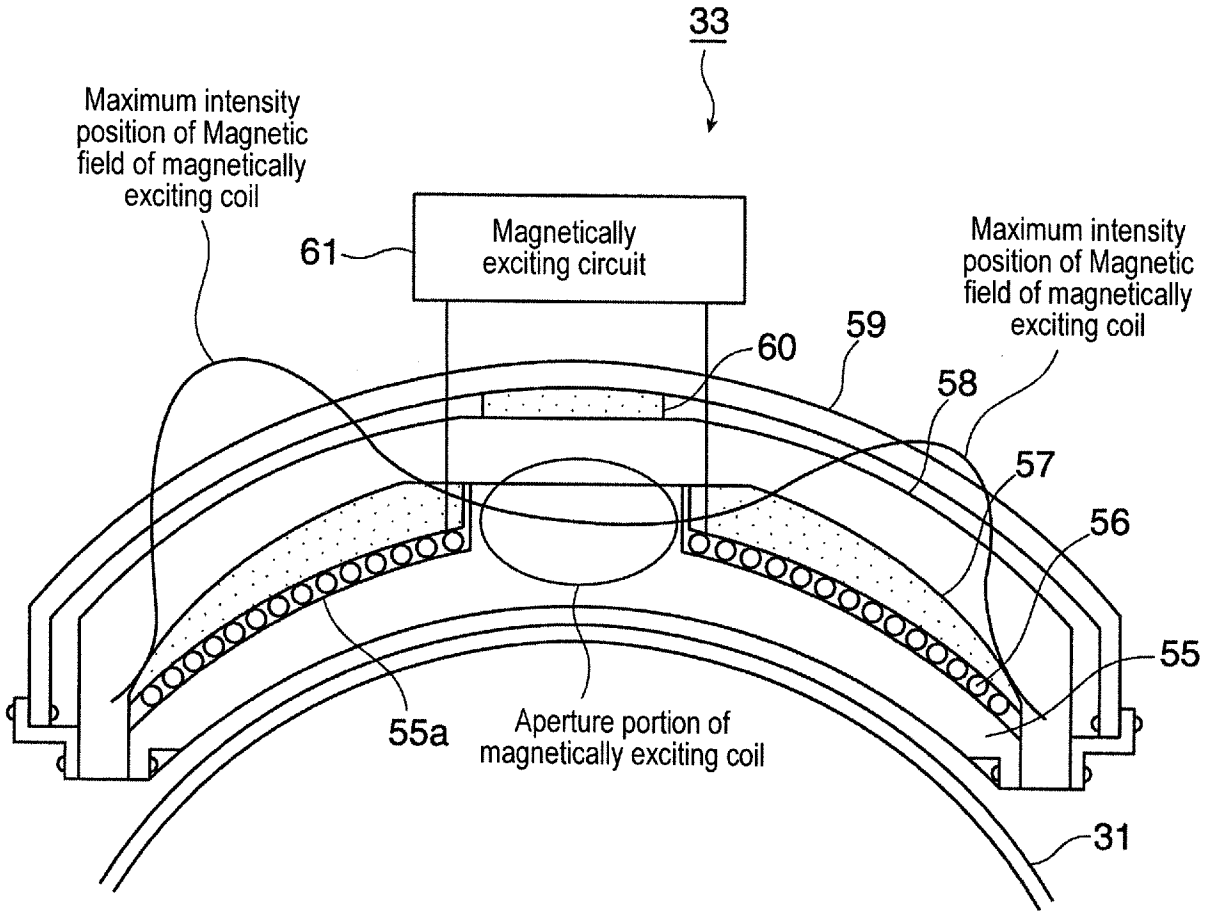
FIG. 8 shows the configuration of the alternative magnetic field generating device.

For example, as shown in FIG. 8, the alternating magnetic field generating device 33 which is disposed on the opposite side of the fixing belt 31 to the pressure application roll 32 is equipped with a support body 55 made of a non-magnetic material such as a heat-resistant resin, the magnetically exciting coil 56 for generating an alternating magnetic field, an elastic support member 57 which is made of an elastic material and serves to fix the magnetically exciting coil 56 to the support body 55, a magnetic core 58 for forming parts, located on the side of the outer circumferential surface of the fixing belt 31, of magnetic paths of the alternating magnetic field generated by the magnetically exciting coil 56, a magnetic shield member 59 for preventing the magnetic field from leaking to the outside, a pressure application member 60 for pressing the magnetic core 58 toward the support body 55, and a magnetically exciting circuit 61 for magnetically energizing the magnetically exciting coil 56 by supplying an AC current to it.

The sectional shape of the end surface, on the side of the fixing belt 31, of the support body 55 is an arc that is curved so as to be concentric with the surface shape of the fixing belt 31 and the sectional shape of its top surface (support surface) 55*a* which supports the magnetically exciting coil 56 is an arc having a predetermined distance (e.g., 0.5 to 2 mm) from the fixing belt 31. Heat-resistant non-magnetic materials including a heat-resistant glass, heat-resistant resins such as polycarbonate, polyethersulphone, and PPS (polyphenylene sulfide), and fiber-reinforced heat-resistant resins obtained by mixing glass fiber into these materials are suitable for the material of the support body 55.

The magnetically exciting coil 56 is formed by winding a Litz wire (e.g., a bundle of 90 0.17-mm-diameter copper wires insulated from each other) so as to assume an elliptical, rectangular, or like closed loop in cross section. An AC current of a prescribed frequency is supplied to the magnetically exciting coil 56 from the magnetically exciting circuit 61, whereby an alternating magnetic field is formed around the magnetically exciting coil 56 (the Litz wire which is wound in closed loop form). The frequency of an AC current that is supplied to the magnetically exciting coil 56 from the magnetically exciting circuit 61 is set in a range of 20 to 100 kHz, for example.

For example, the magnetic core 58 is made of a ferromagnetic material which is a high-permeability oxide or alloy material such as soft ferrite, a ferrite resin, an amorphous alloy, permalloy, or a magnetic compensator alloys flux, and functions as a magnetic path forming member located outside the fixing belt 31. The magnetic core 58 forms such paths of magnetic field lines (magnetic paths) that as shown in FIG. 5 magnetic field lines (magnetic flux) of an alternating magnetic field generated by the magnetically exciting coil 56 start from magnetically exciting coil 56, go toward the heat generation control member 34 crossing the fixing belt 31, go along the heat generation control member 34, and return to the magnetically exciting coil 56. Since those magnetic paths are formed by the magnetic core 58, magnetic field lines (magnetic flux) generated by the magnetically exciting coil 56 are concentrated that region of the fixing belt 31 which is opposed to the magnetic core 58. It is desirable that the magnetic core 58 be made of a material that causes only a small loss due to formation of magnetic paths. More specifically, it is desirable that the magnetic core 58 be used in such a form that the eddy current loss is reduced (e.g., disconnection or division of current paths by recesses etc. and lamination of thin plates), and that the magnetic core 58 be made of a material that is low in hysteresis loss.

As shown in FIG. 1, the pressing member 36 for establishing pressure contact between the fixing belt 31 and the pressure application roll 32 is made of an elastic material such as a silicone rubber or a fluorine rubber and is attached (fixed) to the support member 37 at such a position as to be opposed to the pressure application roll 32. The pressing member 36 is brought into pressure contact with the pressure application roll 32 with the fixing belt 31 interposed in between and thereby forms the nip region N with the pressure application roll 32.

As shown in FIG. 1, the pressing member 36 is provided so that the nip pressure in a pre-nip region 36*a* (an entrance-side portion of the nip region N) which is located on the upstream side in the conveyance direction of a recording sheet 21 is different from that in a peeling nip region 36*b* (an exit-side portion of the nip region N) which is located on the downstream side in the conveyance direction. More specifically, in the pre-nip region 36*a*, the pressure-application-roll-32-side surface of the pressing member 36 has an arc shape that generally conforms to the outer circumferential surface of the pressure application roll 32, whereby a wide, uniform nip region is formed. On the other hand, in the peeling nip region 36*b*, the surface of the pressing member 36 has a convex shape toward the pressure application roll 32 so that the radius of curvature of the fixing belt 31 is reduced and the fixing belt 31 is pressed with a local high pressure. With this structure, the recording sheet 21 that has passed through the peeling nip region 36*b* is curled in such a direction as to go away from the surface of the fixing belt 31 (a downward curl), whereby the peeling of the recording sheet 21 off the surface of the fixing belt 31 is facilitated. As a result, after passing through the nip region N, the recording sheet 21 is deformed so as to form a downward curl and is peeled off the surface of the fixing belt 31 by its own rigidity.

The support member 37 which supports the pressing member 36 is made of a highly rigid material so as to be bent to only a certain degree or less when the pressing member 36 is pressed by the pressure application roll 32 (see FIG. 1). The pressure (nip pressure) in the nip region N is thus kept uniform in the longitudinal direction. Furthermore, the support member 37 is made of a material that never or hardly affects an induction magnetic field and is never or hardly affected by an induction magnetic field. For example, the support member 37 is made of a heat-resistant resin such as PPS (polyphenylene sulfide) mixed with glass fiber or a paramagnetic metal material such as Al, Cu, or Ag.

As shown in FIG. 1, the heat generation control member 34 is disposed inside the fixing belt 31. As shown in FIG. 1, the heat generation control member 34 has such an arc shape as to conform to the inner circumferential surface of the fixing belt 31. The central angle of the arc shape is set at about 160°, for example. To be able to easily receive heat from the fixing belt 31, the heat generation control member 34 is not in contact with but close to the inner circumferential surface of the fixing belt 31 so as to have a predetermined constant gap of about 1 to 3 mm. Furthermore, like the base layer 311 of the fixing belt 31, the heat generation control member 34 is made of a material whose permeability change start temperature is in a prescribed range that is higher than or equal to a heating set temperature of the fixing belt 31 at which toner images of the respective colors are melted and lower than a heatproof temperature of the elastic layer 313 or the surface mold release layer 314 of the fixing belt 31.

The heat generation control member 34 is made of a temperature-sensitive magnetic material. Therefore, the heat generation control member 34 makes a transition in a reversible manner between a ferromagnetic state (the relative permeability is several hundred or more) and a paramagnetic state (non-magnetic state; the relative permeability is approximately equal to 1) in a predetermined temperature range that is higher than or equal to the heating set temperature of the fixing belt 31, for example, in a temperature range between the heating set temperature and a temperature that is higher than it by about 100° C. In the temperature range that is lower than or equal to the permeability change start temperature, the heat generation control member 34 exhibits ferromagnetism and guides a magnetic flux of an alternating magnetic field generated by the alternating magnetic field generating device 33 to form, inside the heat generation control member 34, magnetic paths that extend parallel with the surface of the heat generation control member 34. In the temperature range that is higher than the permeability change start temperature, the heat generation control member 34 exhibits paramagnetism and a magnetic flux generated by the alternating magnetic field generating device 33 passes through the heat generation control member 34 in its thickness direction.

Figure 9:
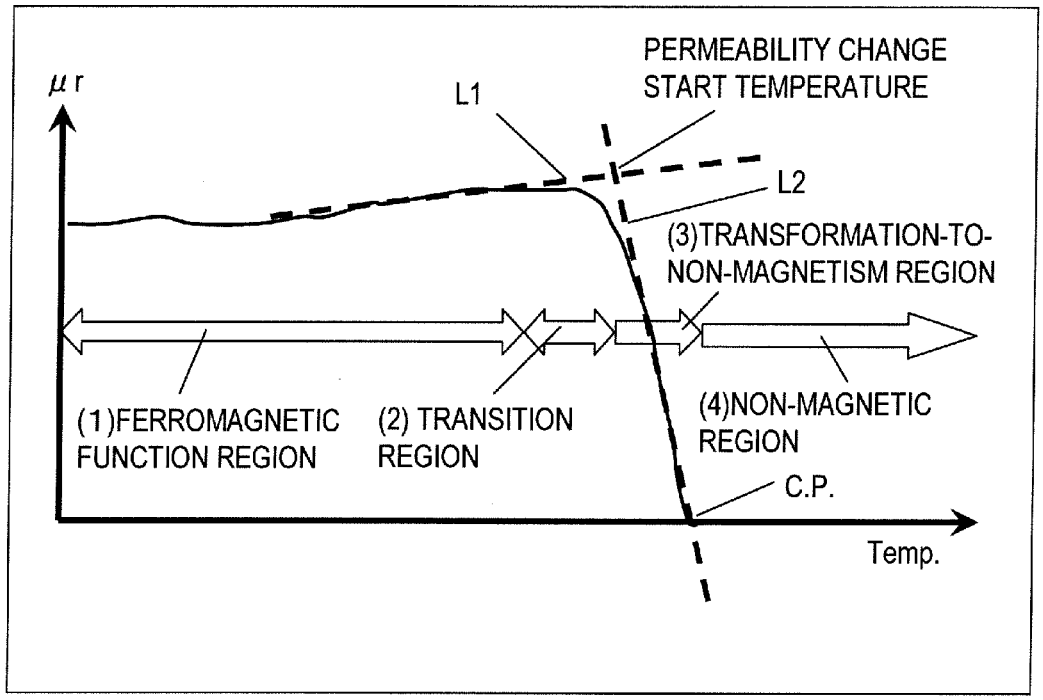
FIG. 9 is a graph showing a temperature-sensitive magnetic property of a heat generation control member.

The temperature-sensitive magnetic property of the heat generation control member 34 will be described further below. As shown in FIG. 9, the heat generation control member 34 has a transition region (2) where the relative permeability $\mu_r$ increases with a small slope, takes a maximum value, and then decreases and a transformation-to-non-magnetism region (3) where the relative permeability $\mu_r$ decreases steeply and approximately linearly and the heat generation control member 34 changes to a non-magnetic (paramagnetic) member between a ferromagnetic function region (1) where the heat generation control member 34 functions as a ferromagnetic member and a non-magnetic region (4) where the heat generation control member 34 is a non-magnetic member. Usually, the Curie point (CP) at which a ferromagnetic material changes to a non-magnetic material means a temperature at which the relative permeability is equal to 1. In the exemplary embodiment, referring to FIG. 9, a permeability change start temperature (that can be regarded as a temperature at which the permeability starts to change) which is the intersecting point of a straight line L1 which approximates the curve in the ferromagnetic function region (1) and a straight line L2 which approximates the curve in the transformation-to-non-magnetism region (3) is called a Curie point.

Figure 10:
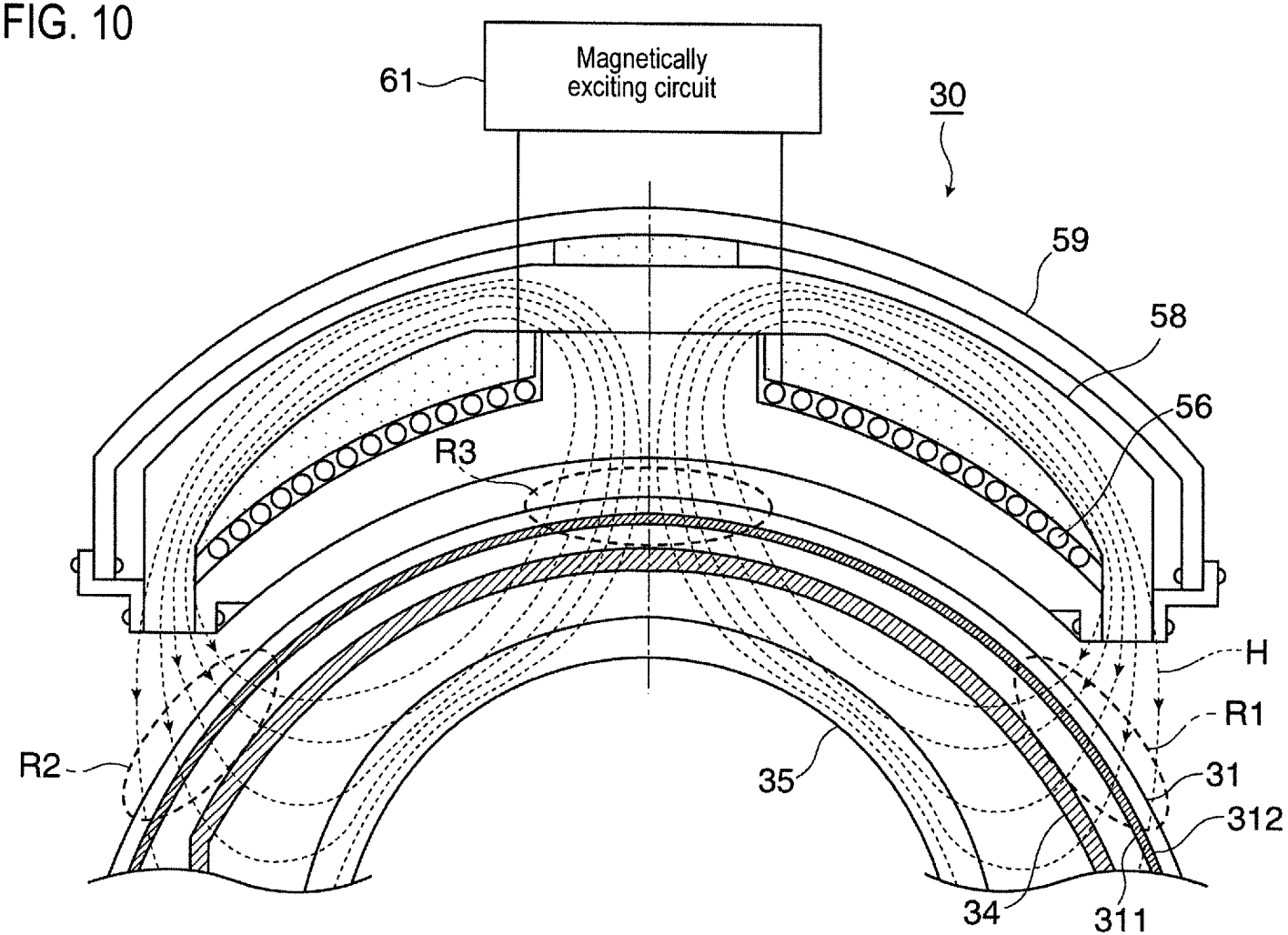
FIG. 10 shows how the magnetic field generated by the alternating magnetic field generating device passes through respective members.

In the temperature range that is lower than or equal to the permeability change start temperature (Curie point) and in which the heat generation control member 34 exhibits ferromagnetism, as shown in FIG. 5 the heat generation control member 34 guides a magnetic flux that is generated by the alternating magnetic field generating device 33 and passes through the fixing belt 31. In the temperature range that is higher than the permeability change start temperature, as shown in FIG. 10 the heat generation control member 34 changes to a non-magnetic (paramagnetic) member and a magnetic flux that is generated by the alternating magnetic field generating device 33 and passes through the fixing belt 31 passes through the heat generation control member 34, that is, crosses it in its thickness direction. As a result, the magnetic flux that passes through the fixing belt 31 and passes through the heat generation control member 34, that is, crosses it in its thickness direction, passes through the space between the heat generation control member 34 and the non-magnetic metal guide member 35 which is located under the heat generation control member 34 and goes along the non-magnetic metal guide member 35.

Like the base layer 311 of the fixing belt 31, the heat generation control member 34 is made of a two-component alloy such as an Fe—Ni alloy (permalloy), a three-component alloy such as an Fe—Ni—Cr alloy, or the like whose permeability change start temperature is set in, for example, a range of 140° C. to 240° C. which is a heating set temperature range of the fixing belt 31. Metal alloys such as permalloy and magnetic compensator alloys flux are suitable for the heat generation control member 34 because, for example, they are superior in thin-sheet moldability and workability, high in thermal conductivity, and inexpensive. Other example materials of the heat generation control member 34 are metal alloys made of elements selected from Fe, Ni, Si, B, Nb, Cu, Zr, Co, Cr, V, Mn, Mo, etc. For example, in the case of an Fe—Ni two-component alloy, the permeability change start temperature can be set at about 225° C. by setting the Fe-to-Ni ratio (number-of-atoms ratio) to 64:36 (see FIG. 4).

In the exemplary embodiment, the thickness of the heat generation control member 34 which is made of an Fe—Ni alloy is set at about 150 μm, which is greater than the thickness 50 μm of the base layer 311 of the fixing belt 31.

For example, where the heat generation control member 34 is made of an Fe—Ni alloy like the base layer 311 of the fixing belt 31 is, the Fe—Ni alloy exhibits room-temperature resistivity ρ of $70\times10^{-8}$ Ω·m and relative permeability $\mu_r$ of 400 in a ferromagnetic state, and the frequency of an alternating magnetic field is 20 kHz, the skin depth δ in the ferromagnetic state is calculated as 149 μm according to the above-mentioned Equation (1). Assuming that the resistivity ρ of the Fe—Ni alloy in a paramagnetic state is approximately equal to that at room temperature (it increases slightly depending on the temperature coefficient), since the relative permeability $\mu_r$ is changed to 1, the skin depth δ in a completely paramagnetic state is calculated as 2,978 μm according to Equation (1). In this case, if the sum of the thickness of the base layer 311 of the fixing belt 31 and the thickness of the heat generation control member 34 is greater than the skin depth 149 μm in the ferromagnetic state, magnetic field lines H of the alternating magnetic field generated by the alternating magnetic field generating device 33 form a magnetic paths of $(1-1/e)\times100$ (%) or more in the ferromagnetic state.

When magnetic field lines H of an alternating magnetic field act on the heat generation control member 34, eddy current I flows in the heat generation control member 34. For example, if the heat generation control member 34 is made thinner, the electric resistance R of the heat generation control member 34 is increased and hence the eddy current I flowing in the heat generation control member 34 is decreased. The heat generated in the heat generation control member 34 is thus decreased.

The Joule heat W caused by the eddy current loss of the eddy current I generated in the heat generation control member 34 is given by $W=I^2R$; that is, the eddy current I contributes to the Joule heat W as its square. Therefore, the heat W generated in the heat generation control member 34 can be reduced by increasing the electric resistance R of the heat generation control member 34 or decreasing the eddy current I.

The electric resistance R of the heat generation control member 34 is given by the following Equation (2), where ρ is the resistivity (Ω·m) of the heat generation control member 34, S is the cross section of the heat generation control member 34, and L is the path length of the eddy current I flowing in the heat generation control member 34. As seen from Equation (2), when the heat generation control member 34 is made thinner, the cross section S of the heat generation control member 34 is decreased and the electric resistance R of the heat generation control member 34 is increased.

$$R=\rho(L/S) \tag{2}$$

Now, let t0 represent the thickness of the heat generation control member 34, t1 the depth of entrance of a major flux in a ferromagnetic state, and t2 the skin depth in a paramagnetic state. Where t0>t1, the eddy current I flowing in the portion having the thickness (t0−t1) is small. However, when the heat generation control member 34 turns paramagnetic, the skin depth δ of the heat generation control member 34 changes to 2,978 μm and the eddy current I flows in the entire heat generation control member 34 having the thickness t0, that is, the thickness of the eddy current flowing portion is increased. Therefore, in a state that the heat generation control member 34 is paramagnetic, the cross section S of the heat generation control member 34 is increased as seen from Equation (2) and the electric resistance R of the heat generation control member 34 having the high resistivity is decreased. The heat generation control member 34 thus heats more easily. In summary, in the heat generation control member 34, it is preferable that the depth t1 of entrance of a magnetic flux in a ferromagnetic state be as small as possible to decrease the thickness of the eddy current flowing portion and thereby increase the electric resistance R and that the electric resistance R in a paramagnetic state be made large.

Next, where t0<t1, the eddy current I flows in the entire heat generation control member 34 having the thickness t0, which corresponds to a case that the cross section S of the heat generation control member 34 is at the maximum and the electric resistance R is at the minimum In this case, both of the eddy current flowing thickness in a ferromagnetic state and that in a paramagnetic state are equal to t0. Therefore, where t0<t1, the heat generation amount is made smaller by an amount corresponding to the skin depth δ minus the thickness t0 of the heat generation control member 34.

That is, where the thickness t0 (e.g., 100 μm) of the heat generation control member 34 is smaller than the depth t1 of entrance of a major magnetic flux in a ferromagnetic state, the eddy current I is decreased as the electric resistance R of the heat generation control member 34 is decreased, whereby the Joule heat W ($=I^2R$) generated in the heat generation control member 34 is minimized The Joule heat W in a ferromagnetic state can be suppressed by increasing the electric resistance R by making the depth t1 of entrance of a magnetic flux as small as possible. On the other hand, the self-heat-generation in the heat generation control member 34 due to the eddy current I can be suppressed by increasing the electric resistance R in a paramagnetic state (skin depth: t2). An appropriate method for increasing the electric resistance R by decreasing the depth t1 of entrance of a magnetic flux is to increase the relative permeability of the heat generation control member 34. A large relative permeability is a desirable characteristic of the magnetic path forming member because the degree of magnetic coupling and the magnetic flux density are high. The relative permeability can be increased by subjecting the heat generation control member 34 to teat treatment (full annealing).

The non-magnetic metal guide member 35 which is disposed inside the heat generation control member 34 is made of a non-magnetic metal having a relatively small resistivity such as Ag, Cu, or Al. As shown in FIG. 10, the non-magnetic metal guide member 35 guides an alternating magnetic field (magnetic field lines) generated by the alternating magnetic field generating device 33 and establishes, in itself, a state that eddy current I occurs more easily than in the conductive layer 312 of the fixing belt 31 or the heat generation control member 34 when the temperatures of the base layer 311 of the fixing belt 31 and the heat generation control member 34 have become higher than the permeability change start temperature. To this end, to facilitate flowing of eddy current I, the non-magnetic metal guide member 35 is formed so as to have a prescribed thickness (e.g., 1 mm) which is sufficiently greater than the skin depth.

In the fixing device 30 having the above-described configuration, processing of fixing toner images to a recording sheet is performed in the following manner.

To fix toner images (e.g., full-color toner images) that have been transferred to a recording sheet 21 in a multiple manner (see FIG. 1), the fixing belt 31 is rotationally driven at a predetermined rotation speed by starting the drive motor 48 (see FIG. 7) and supplying an alternative current of a predetermined frequency to the magnetically exciting coil 56 from the magnetically exciting circuit 61 of the alternating magnetic field generating device 33.

As a result, in the fixing device 30, as shown in FIG. 5, an alternating magnetic field (magnetic field lines) is generated by the magnetically exciting coil 56 of the alternating magnetic field generating device 33, whereby mainly the heat generation layer 311 of the fixing belt 31 heats through electromagnetic induction and the fixing belt 31 is heated to a predetermined fixing temperature.

In the fixing device 30, when the fixing belt 31 has been heated to a predetermined fixing temperature Tf, a recording sheet 21 to which toner images have been transferred is conveyed to the nip region N between the fixing belt 31 and the pressure application roll 32 (see FIG. 1) and the toner images are heated and melted by the heating and pressing by the fixing belt 31 and the pressure application roll 32 and thus fixed to the recording sheet 21. Then, the recording sheet 21 is peeled off the fixing belt 31 and ejected by the ejection rolls 22 to the ejection tray 23 which constitutes the top portion of the color image forming apparatus 1 (see FIG. 2).

In the color image forming apparatus 1, an image of any of various kinds of sizes such as A3, A4, B4, B5, and letter can be formed on a recording sheet 21. In the color image forming apparatus 1, as shown in FIG. 11, a recording sheet 21 is conveyed in such a manner that its center in the direction perpendicular to the conveyance direction is used as a reference (what is called center registration).

Figure 11:
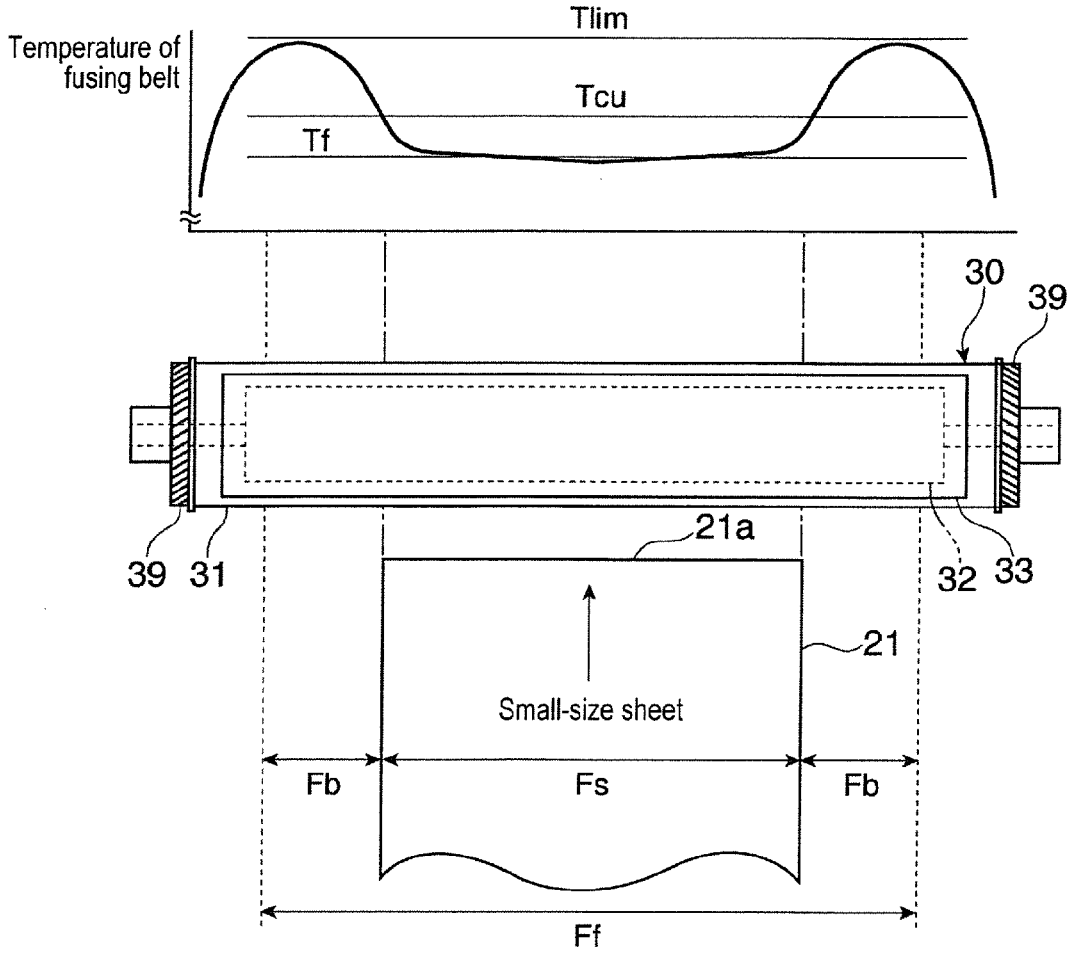
FIG. 11 illustrates a temperature profile along the axial direction of the fixing belt.

In the color image forming apparatus 1, for example, when as shown in FIG. 11 A4-size recording sheets 21 are conveyed consecutively with a shorter sideline 21*a* as the head (short edge feed (SEF)), the temperature of a sheet feed portion Fs of the fixing belt 31 that conveys recording sheets 21 actually is kept around the predetermined fixing temperature Tf by setting the heat generation amount of the heat generation layer 312 of the fixing belt 31 so that it is balanced with a heat amount that is necessary for fixing to thereby have the recording sheets 21 absorb heat from the fixing belt 31. On the other hand, the temperature of non-sheet-feed portions Fb of the fixing belt 31 that do not convey recording sheets 21 actually is increased to close to an upper limit temperature Tlim which is higher than the predetermined fixing temperature Tf because recording sheets 21 absorb no heat from the fixing belt 31.

When the temperature of the non-sheet-feed portions Fb of the fixing belt 31 is increased to close to the upper limit temperature Tlim, the temperature of the base layer 311, made of a temperature-sensitive magnetic material, of the fixing belt 31 exceeds the permeability change start temperature which is set at about 225° C., for example, and hence it changes from a ferromagnetic state to a non-magnetic state. At the same time, the heat generation control member 34 which is disposed inside the fixing belt 31 so as not to be in contact with the fixing belt 31 and which is made of a temperature-sensitive magnetic material like the base layer 311 of the fixing belt 31 is heated receiving heat that is transmitted from the fixing belt 31 via the air. The heat generation control member 34 is also heated by an alternating magnetic field generated by the alternating magnetic field generating device 33. The temperature of the heat generation control member 34 exceeds the permeability change start temperature and hence the heat generation control member 34 also changes from a ferromagnetic state to a non-magnetic state.

At this time, the temperature of the heat generation control member 34 is determined by heat (self-heat-generation amount) W generated in itself by an alternating magnetic field generated by the alternating magnetic field generating device 33 and heat received from the fixing belt 31. As described above, the Joule heat W of the heat generation control member 34 is given by $W=I^2R$, that is, it depends on the electric resistance R of the heat generation control member 34 and the magnitude of the eddy current I.

When as mentioned above the base layer 311 of the fixing belt 31 and the heat generation control member 34 change to a non-magnetic state, as shown in FIG. 10 the alternating magnetic field generated by the alternating magnetic field generating device 33 passes through the base layer 311 of the fixing belt 31 and the heat generation control member 34, passes through the space between the heat generation control member 34 and the non-magnetic metal guide member 35, goes along the non-magnetic metal guide member 35, and returns to the magnetically exciting coil 56. The density of the magnetic flux that goes along each of the heat generation layer 312 of the fixing belt 31 and the heat generation control member 34 decreases and the heat generated in each of the heat generation layer 312 of the fixing belt 31 and the heat generation control member 34 is decreased. The temperature of the non-sheet-feed portions Fb lowers (see FIG. 11). In this manner, while recording sheets 21 are conveyed consecutively, the fixing processing is continued with the temperature increase of the non-sheet-feed portions Fb of the fixing belt 31 suppressed.

As described above, when the temperature of the non-sheet-feed portions Fb of the fixing belt 31 has increased to exceed the permeability change start temperature, the heat generation control member 34 changes to a non-magnetic state together with the base layer 311 of the fixing belt 31. As a result, as shown in FIG. 10, the heat generation control member 34 transmits an alternating magnetic field generated by the alternating magnetic field generating device 33 together with the base layer 311 of the fixing belt 31 and thereby decreases the density of a magnetic flux that goes along the heat generation layer 312 of the fixing belt 31. The heat generation control member 34 thus suppresses temperature increase of the non-sheet-feed portions Fb of the fixing belt 31.

Furthermore, in the exemplary embodiment, as shown in FIGS. 5 and 10, the heat generation control member 34 is a member for forming magnetic paths together with the magnetic core 58 (external magnetic path forming member) of the alternating magnetic field generating device 33. The magnetic paths formed by the heat generation control member 34 depend on the relative permeability etc. of the heat generation control member 34. Containing a temperature-sensitive magnetic material whose relative permeability $\mu_r$ varies depending on the temperature, the heat generation control member 34 has a function of a temperature sensor for detecting an excessive temperature increase of the fixing belt 31 utilizing the feature that its magnetic property varies steeply around the permeability change start temperature.

As shown in FIG. 9, the conditions that the heat generation control member 34 should satisfy to suppress temperature increase of the non-sheet-feed portions Fb of the fixing belt 31 are that the portion, corresponding to the sheet feed portion Fs, of the heat generation control member 34 which is made of a temperature-sensitive magnetic material is kept in the ferromagnetic function region (1) or the transition region (2) and that its portions corresponding to the non-sheet-feed portions Fb are kept in the transformation-to-non-magnetism region (3) or the non-magnetic region (4).

More specifically, it is necessary to continues to form closed magnetic paths with the magnetically exciting coil 56 by establishing a high magnetic flux density in the sheet feed portion Fs of the fixing belt 31 (see FIG. 5) by keeping the temperature of the sheet feed portion Fs at about 140° C. to 160° C. (lower than the permeability change start temperature and its neighborhood) and letting the heat generation control member 34 function as a ferromagnetic member. It is necessary to increase the eddy current I flowing in the fixing belt 31 by increasing the magnetic flux density and strengthening the magnetic coupling by keeping the heat generation control member 34 ferromagnetic and thereby continuing to form closed magnetic paths.

On the other hand, as shown in FIG. 11, the non-sheet-feed portions Fb of the fixing belt 31 are in a temperature range that is higher than the permeability change start temperature (Tcu) and its neighborhood and the corresponding portions of the heat generation control member 34 change to a non-magnetic state. As a result, as shown in FIG. 10, the magnetic flux density in the non-sheet-feed portions Fb of the fixing belt 31 is reduced. Since the heat generation control member 34 changes to a non-magnetic state, the magnetic flux penetrates through it and is guided to the non-magnetic metal guide member 35, whereby the eddy current I flowing in the fixing belt 31 is reduced. As a result, the heat generation in the non-sheet-feed portions Fb of the fixing belt 31 is reduced.

Figure 12:
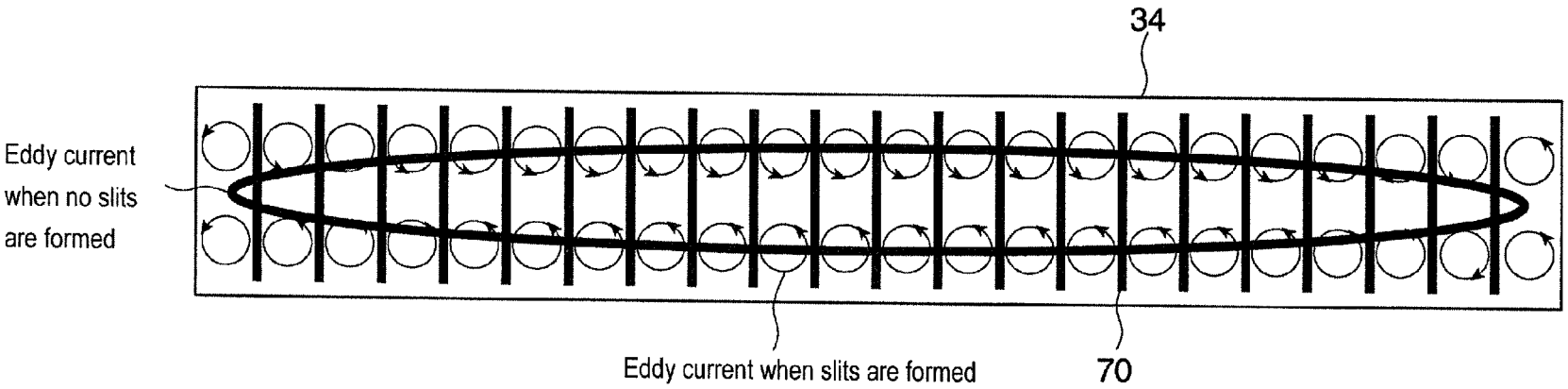
FIG. 12 is a schematic diagram showing how eddy currents occur when slits are formed.

However, self-heat-generation occurs in the heat generation control member 34 due to eddy current loss and hysteresis loss that are caused by an electromagnetically induced magnetic flux. If the self-heat-generation amount is large, the temperature of the heat generation control member 34 is increased. There may occur an event that the temperature of the heat generation control member 34 exceeds the permeability change start temperature due to self-heat-generation and the permeability change start temperature changes to a non-magnetic state although the temperature of the fixing belt 31 is not so high that its heat generation should be suppressed. That is, the heat generation suppressing effect appears when it is not necessary to suppress heat generation. In the exemplary embodiment, the heat generation control member 34 is a member that is necessary for suppressing the temperature of the non-sheet-feed portions Fb of the fixing belt 31. Therefore, it is necessary that unintended temperature increase due to self-heat-generation be minimized To this end, slits 70 are used as controlling portions according to the exemplary embodiment (recesses or space portions may be used as the controlling portions instead of the slits 70). To suppress unintended temperature increase in the heat generation control member 34 due to self-heat-generation, as shown in FIG. 12, plural slits 70 are formed in the heat generation control member 34 in a direction that crosses the longitudinal direction of the heat generation control member 34 (i.e., the axial direction of the fixing belt 31) approximately at 90° so as to be arranged in the longitudinal direction at predetermined intervals. When the heat generation control member 34 is in a ferromagnetic state, a large-scale flow of eddy current is interrupted by the slits 70 and the heat generation in the heat generation control member 34 is suppressed.

Figure 18A:
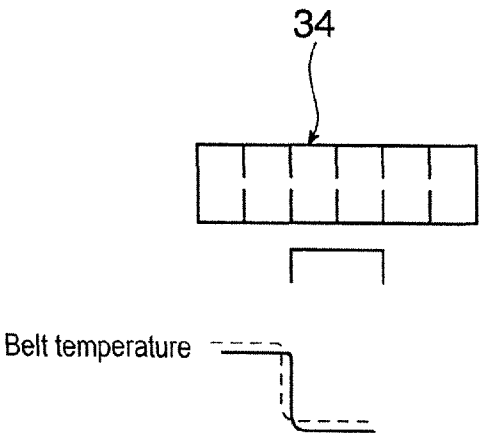
FIGS. 18A to 18C illustrate temperature profile variations of the fixing belt in a case that the heat generation control member has a continuous portion, a case that the heat generation control member does not have a continuous portion, and a case that the heat generation control member does not have slits.
Figure 18B:
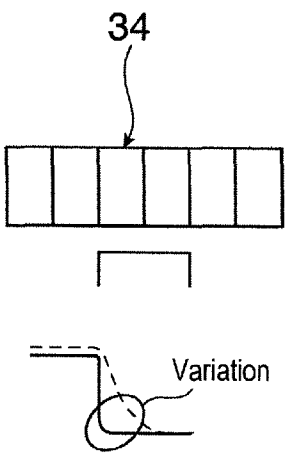

However, if plural non-divided slits were formed in the heat generation control member 34 so as to extend in the direction that crosses the longitudinal direction of the heat generation control member 34 approximately at 90° (for example, as shown in FIG. 18B), although a flow of eddy current would be interrupted and the heat generation in the heat generation control member 34 could be suppressed, the time when the temperature of the heat generation control member 34 exceeds the permeability change start temperature (Tcu) because of increase of the temperature of the non-sheet-feed portions Fb of the fixing belt 31 to around the upper limit Tlim would be delayed. Even if the temperature of the sheet feed portion Fs of the fixing belt 31 is low at the beginning, heat is transmitted to it from the non-sheet-feed portions Fb past their boundaries (i.e., heat conduction through the fixing belt 31 itself), as a result of which a temperature difference occurs between the center and the ends of the sheet feed portion Fs. However, this temperature difference is smaller than the temperature difference between the sheet feed portion Fs and the non-sheet-feed portions Fb. Furthermore, in the exemplary embodiment, since the air layer exists between the fixing belt 31 and the heat generation control member 34, it takes time for the temperature of the heat generation control member 34 to reach the temperature of the fixing belt 31. Therefore, even if the temperature of the non-sheet-feed portions Fb of the fixing belt 31 is increased to around the upper limit Tlim, the heat generation control member 34 is left ferromagnetic and the heat generation in the non-sheet-feed portions Fb of the fixing belt 31 is continued. Heat is transmitted (conducted) from the non-sheet-feed portions Fb to the sheet feed portion Fs, whereby the temperature around the ends of the sheet feed portion Fs of the fixing belt 31 becomes much higher than the preset fixing temperature 140° C. to 160° C., that is, increases to about 200° C. This may cause a high-temperature offset in toner images on a recording sheet 21.

In view of the above, in the exemplary embodiment, whereas excessive temperature increase of the heat generation control member 34 is prevented by the slits 70, a high-temperature offset due to excessive temperature increase around the ends of the sheet feed portion Fs of the fixing belt 31 can be prevented from occurring in toner images on a recording sheet 21 by leaving a heat conduction portion in the heat generation control member 34 without the slits 70 passing through the heat generation member 34. The portion thus left is a continuous portion 72 according to the exemplary embodiment.

A temperature profile variation of the case of the exemplary embodiment with the slits 70 and the continuous portion 72 will be described below in comparison with temperature profile variations of a case in which the slits 70 are formed but no continuous portion 72 is formed and the case where only the continuous portion 72 is provided but no slits 70 are formed.

Figure 18C:
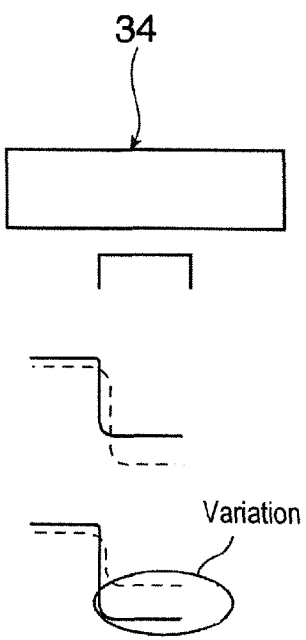

In the case with the slits 70 and the continuous portion 72, as shown in FIG. 18A, a control can be made so as to attain an intended temperature profile both at an initial stage and during a consecutive sheet feed operation. In contrast, in the case where the slits 70 are formed but no continuous portion 72 is formed, as shown in FIG. 18B, although a control can be made so as to attain an intended temperature profile an initial stage, a control cannot be performed properly during a consecutive sheet feed operation. More specifically, even when the temperature of the non-sheet-feed portions Fb of the fixing belt 31 is increased around the upper limit Tlim in a consecutive sheet feed operation, heat is not transmitted from the portions, corresponding to the non-sheet-feed portions Fb, of the heat generation control member 34 to the portion corresponding to the sheet feed portion Fs because it is interrupted by the slits 70. Therefore, the portions, corresponding to the non-sheet-feed portions Fb, of the heat generation control member 34 remain ferromagnetic and the heat generation is continued in the non-sheet-feed portions Fb of the fixing belt 31. Heat is transmitted (conducted) from the non-sheet-feed portions Fb of the fixing belt 31 to the sheet feed portion Fs, whereby the temperature around the ends of the sheet feed portion Fs of the fixing belt 31 becomes much higher than the preset fixing temperature 140° C. to 160° C., that is, increases to about 200° C. This may cause a high-temperature offset in toner images on a recording sheet 21.

Where no slits 70 are formed, a shown in FIG. 18C, although a control can be made so as to attain an intended temperature profile an initial stage, a control cannot be performed properly during a consecutive sheet feed operation. More specifically, when the temperature of the portions, corresponding to the non-sheet-feed portions Fb, of the heat generation control member 34 is increased, heat is transmitted from the portions, corresponding to the non-sheet-feed portions Fb, of the heat generation control member 34 to the portion corresponding to the sheet feed portion Fs. The entire heat generation control member 34 changes to a non-magnetic state, whereby the heat generation is stopped in the non-sheet-feed portions Fb and the sheet feed portion Fs of the fixing belt 31. As a result, the temperature of the sheet feed portion Fs of the fixing belt 31 may lower undesirably.

In the exemplary embodiment, the continuous portion 72 is continuous over the entire longitudinal length of the heat generation control member 34.

Figure 13:
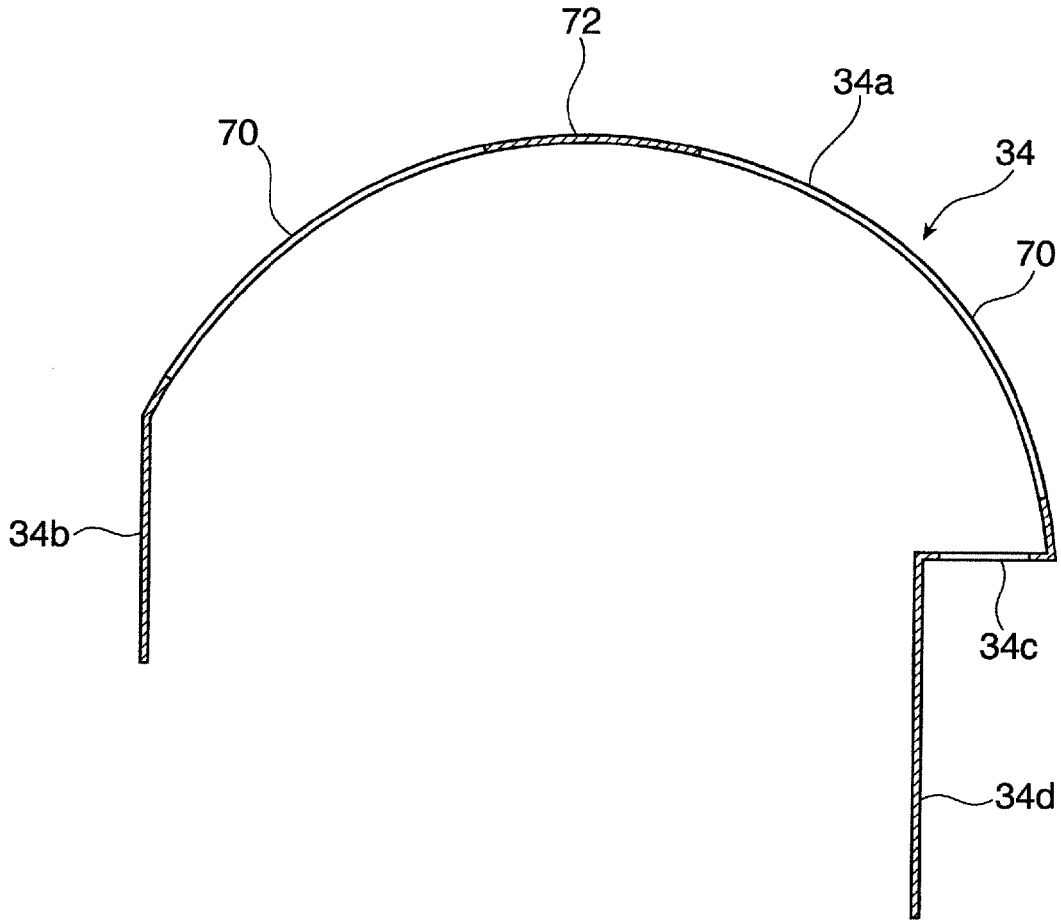
FIG. 13 is an enlarged sectional view of the heat generation control member.

As shown in FIG. 13, a central portion 34*a* of the heat generation control member 34 of the exemplary embodiment has an arc shape having a predetermined central angle θ so as to be opposed to the inner circumferential surface of the fixing belt 31 with a predetermined gap. One end portion, in the circumferential direction, of the heat generation control member 34 is bent downward (see FIG. 13) to form a downward extending portion 34*b*, which is fixed, by screwing or the like, to an auxiliary member 62 which is attached to the support member 37 (see FIG. 1). The other end portion of the heat generation control member 34 is bent approximately toward the center of the arc shape to form a short radial portion 34*c* and then bent downward by approximately 90° to form a downward extending portion 34*d* having a predetermined length. As shown in FIG. 1, the downward extending portion 34*d* is fixed to the support member 37 together with an end portion of the non-magnetic metal guide member 35 by screwing or the like.

As described above, the heat generation control member 34 is a thin plate of 100 to 200 μm, for example, in thickness which is made of an alloy of, for example, an Fe—Ni two-component magnetic compensator alloys flux. Although the thin plate is low in rigidity, the rigidity of the heat generation control member 34 can be increased by deforming it as shown in FIG. 13.

However, forming the plural slits 70 (slit group) in the manner shown in FIG. 12 lowers the rigidity of the heat generation control member 34.

Figure 14:
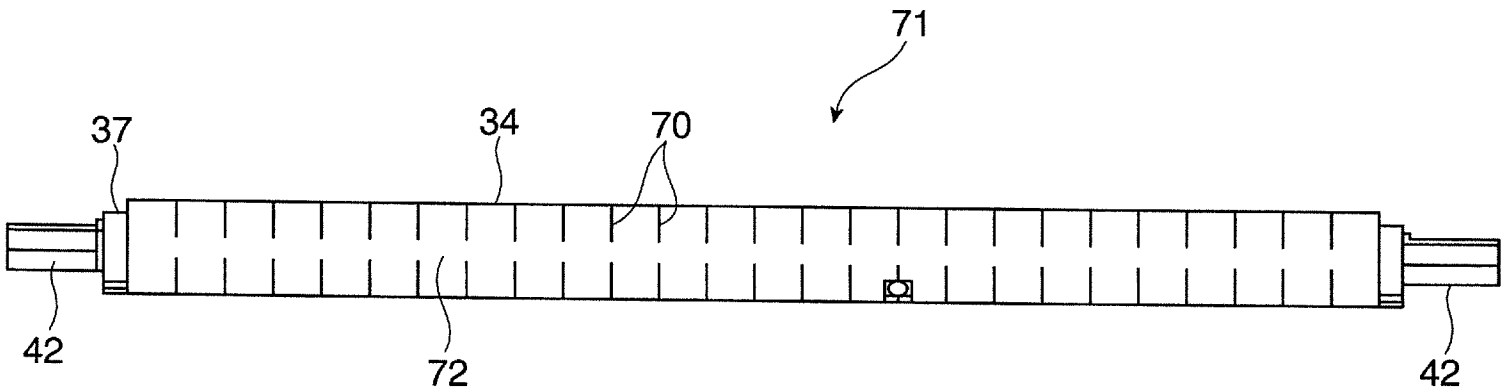
FIG. 14 is a plan view showing the structure of the heat generation control member.

In the exemplary embodiment, as shown in FIG. 14, to suppress unintended temperature increase in the heat generation control member 34 due to self-heat-generation, the plural slits 70 (slit group 71; an example of interrupting portions of the magnetic path forming member) are formed in the heat generation control member 34 in the direction that crosses the longitudinal direction of the heat generation control member 34 (i.e., the axial direction of the fixing belt 31) approximately at 90° so as to be arranged in the longitudinal direction at predetermined intervals. When the heat generation control member 34 is in a ferromagnetic state, a large-scale flow of eddy current is interrupted by the slits 70 and the heat generation in the heat generation control member 34 is suppressed.

However, the slits 70 are not formed in the entire area of the arc portion 34*a* of the heat generation control member 34. That is, no slits 70 are formed in that portion of the heat generation control member 34 which corresponds to the region R3 which includes a top portion of the arc shape 34*a* to form the continuous portion 72 which is continuous over the entire longitudinal length of the heat generation control member 34.

With the above structure, since the continuous portion 72 extends over the entire longitudinal length of the heat generation control member 34, the heat generation control member 34 which is a thin plate is increased in rigidity and shaped more easily.

The width of the continuous portion 72 is determined taking into consideration such parameters as the thickness t of the heat generation control member 34 and an aperture width of the magnetically exiting coil 56 (described later), the heat generated by eddy current flowing in the continuous portion 72, and other factors.

In the exemplary embodiment, whereas the slits 70 are formed in the heat generation control member 34, naturally, no slits 70 are formed in the downward extending portions 34*b* and 34*d* (attaching portions) which are opposed to respective end portions of the magnetically exiting coil 56 (described later) because no large eddy current flows there (see FIG. 13). Furthermore, the slits 70 do not extend to edge portions which are boundaries between the arc portion 34*a* and the downward extending portion 34*b* and between the arc portion 34*a* and the short radial portion 34*c*. Slits 70 are formed in the short radial portion 34*c* itself to enhance the intended effect of the slip group 71 because the short radial portion 34*c* is irrelevant to the rigidity of the heat generation control member 34 and is influenced by a magnetic field though it is short.

In the fixing device 30, as shown in FIG. 11, fixing is performed by conveying a small-size (e.g., A4) recording sheet 21 with a shorter sideline 21*a* as the head (short edge feed). Even when the temperature of the non-sheet-feed portions Fb of the fixing belt 31 is increased and the temperature of the base layer 311 of the fixing belt 31 becomes higher than the permeability change start temperature (Tcu), the self-heat-generation in the heat generation control member 34 is suppressed because eddy current that is caused to flow in the heat generation control member 34 through electromagnetic induction is interrupted by the plural slits 72 (slit group 71) which are formed in the heat generation control member 34 (see FIG. 14).

As a result, the temperature increase of the heat generation control member 34 is suppressed, which prevents a phenomenon that the temperature of the heat generation control member 34 exceeds the permeability change start temperature (Tcu) and the heat generation control member 34 turns non-magnetic though such a change is not necessary and the heat generation in the heat generation layer 312 of the fixing belt is suppressed undesirably (see FIG. 10), that is, a phenomenon that the degree of magnetic coupling lowers undesirably or the effect of suppressing temperature increase in the non-sheet-feed portions Fb appears with improper timing.

Figure 19A:
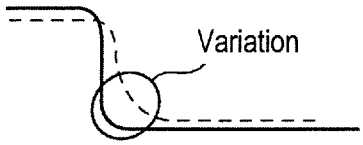
FIGS. 19A and 19B illustrate temperature profile variations of the heat generation control member in cases that the continuous portion is provided at different positions.
Figure 19B:
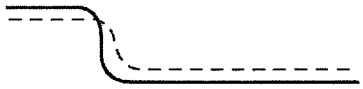

Furthermore, as shown in FIG. 14, in the heat generation control member 34, the continuous portion 72 which is continuous over the entire longitudinal length of the heat generation control member 34 interrupts the slits 70 (slit group 71). In the exemplary embodiment, the continuous portion 72 is provided at such a position as not to affect the self-heat-generation suppressing effect much (see FIGS. 12 and 14).

Where the continuous portion 72 is provided at such a position as not to affect the self-heat-generation suppressing effect much (see FIGS. 12 and 14), as shown in FIG. 19A, the temperature of the portion, corresponding to the sheet feed portion Fs, of the heat generation control member 34 is increased by heat conduction through the continuous portion 72 in a consecutive fixing operation and a temperature variation is made different than at an initial state around the ends of the portion, corresponding to the sheet feed portion Fs, of the heat generation control member 34. In contrast, where the continuous portion 72 is provided at such a position as to affect the self-heat-generation suppressing effect, as shown in FIG. 19B, the temperature of the portion, corresponding to the sheet feed portion Fs, of the heat generation control member 34 is increased by heat conduction through the continuous portion 72 in a consecutive fixing operation and a temperature variation may be made different than at an initial state also in portions other than the ends of the portion and their neighborhoods, corresponding to the sheet feed portion Fs, of the heat generation control member 34.

As shown in FIG. 12, a main eddy current path in the heat generation control member 34 is an orthogonal projection of the shape of the confronting magnetically exciting coil 56. The continuous portion 72 is located in that area of the heat generation control member 34 which is opposed to the coil aperture portion (see FIG. 8) and is in the region R3 (see FIG. 10); eddy current is thus small in the area where the continuous portion 72 is provided. As seen from the magnetic field intensity distribution of the magnetically exciting coil 56 shown in FIG. 8, in the heat generation control member 34 largest eddy current flows at the positions that are opposed to the maximum magnetic field intensity positions of the magnetically exciting coil 56. No large eddy current flows (or eddy current is hard to flow) in the area that is opposed to the coil aperture portion because the magnetic field intensity is low there and that area is located at the center of the main eddy current path. Therefore, even if the continuous portion 72 is provided, the self-heat-generation suppressing effect can be kept approximately the same. The most desirable position(s) of the continuous portion 72 is the position(s) that is opposed to the coil aperture portion or the coil ends or their neighborhoods. In the exemplary embodiment, the continuous portion 72 is located at such a position.

The exemplary embodiment is characterized in that the slits 70 are formed in the heat generation control member 34 across what is called the main eddy current path where large eddy current flows and that the continuous portion 72 is formed in the area where no large eddy current flows. In particular, whereas the continuous portion 72 is a heat generation portion opposed to the magnetically exciting coil 56 though heat generation does not occur there easily, a large amount is heat is transmitted to that area from the fixing belt 31. This area is most appropriate for heat conduction in the axial direction in the heat generation control member 34 itself.

Figure 15:
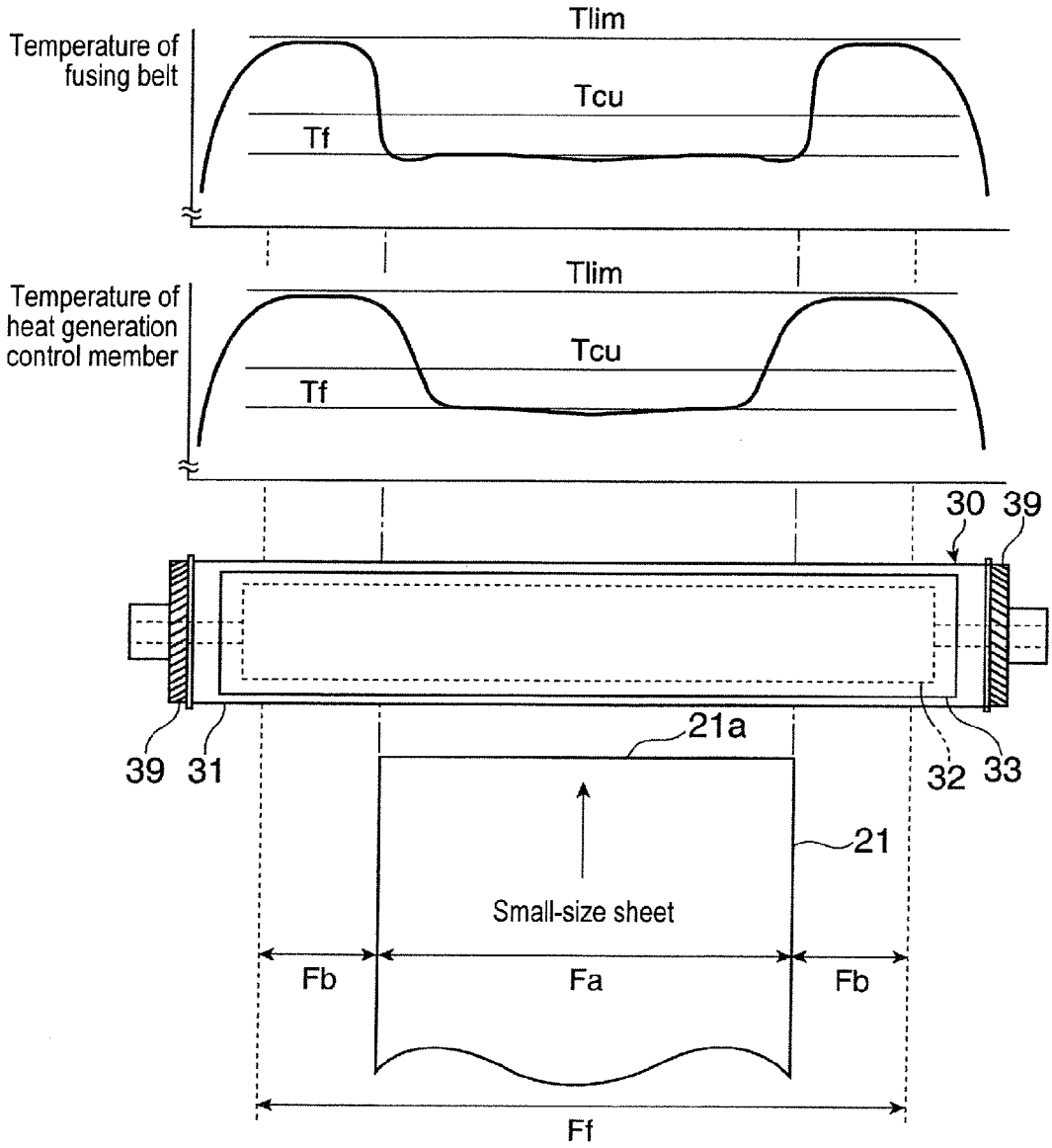
FIG. 15 illustrates temperature profiles along the axial direction of the fixing belt and the heat generation control member.

As a result, as shown in FIG. 15, when the temperature of the non-sheet-feed portions, corresponding to the non-sheet-feed portions Fb of the fixing belt 31, of the heat generation control member 34 is increased as the temperature of the non-sheet-feed portions Fb of the fixing belt 31 is increased and self-heat generation occurs in the continuous portion 72 of the heat generation control member 34, the temperature of the heat generation control member 34 exceeds the permeability change start temperature (Tcu) and the permeability change start temperature changes to a non-magnetic state. The heat generation control member 34 thus prevents excessive temperature increase of the non-sheet-feed portions Fb of the fixing belt 31 (see FIG. 10).

Furthermore, the heat generation control member 34 is provided with the continuous portion 72, the portions, corresponding to the non-sheet-feed portions Fb of the fixing belt 31, of the heat generation control member 34 has been increased to as to exceed the permeability change start temperature (Tcu), heat is transmitted (conducted) from the portions, corresponding to the non-sheet-feed portions Fb, of the heat generation control member 34 to the portion, corresponding to sheet feed portion Fs, of the heat generation control member 34, whereby the temperature of portions adjacent to the boundaries, of the sheet feed portion, corresponding to the sheet feed portion Fs, of the heat generation control member 34 becomes higher than the permeability change start temperature (Tcu) (see FIG. 14).

As a result, the portions, adjacent to the boundaries, of the sheet feed portion, corresponding to the sheet feed portion Fs, of the heat generation control member 34 changes to a non-magnetic state, and the magnetic flux of the magnetic field generated by the magnetically exciting coil 56 passes through the portions, adjacent to the boundaries, of the sheet feed portion, corresponding to the sheet feed portion Fs, of the heat generation control member 34. The magnetic flux density decreases in the portions, adjacent to the non-sheet-feed portions Fb, of the heat generation layer 312 of the sheet feed portion Fs of the fixing belt 31, and hence the heat generation is suppressed in the portions around the ends of the heat generation layer 312 of the sheet feed portion Fs of the fixing belt 31.

As such, in the fixing device 30, even when small-size recording sheets 21 are conveyed through it consecutively, both of an event that the temperature of portions around the ends of the sheet feed portion Fs of the fixing belt 31 is increased excessively and an event that a high-temperature offset occurs in recording sheets 21 due to, for example, temperature increase around the ends of the sheet feed portion Fs of the fixing belt 31 can be prevented.

Exemplary Embodiment 2

Figure 16A:
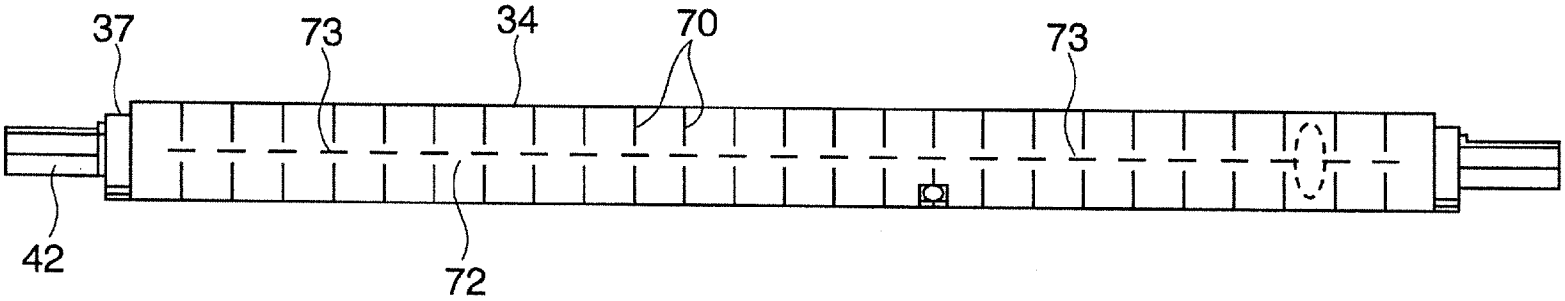
FIGS. 16A and 16B are plan views showing the structures of heat generation control members according to a second exemplary embodiment of the invention.
Figure 16B:
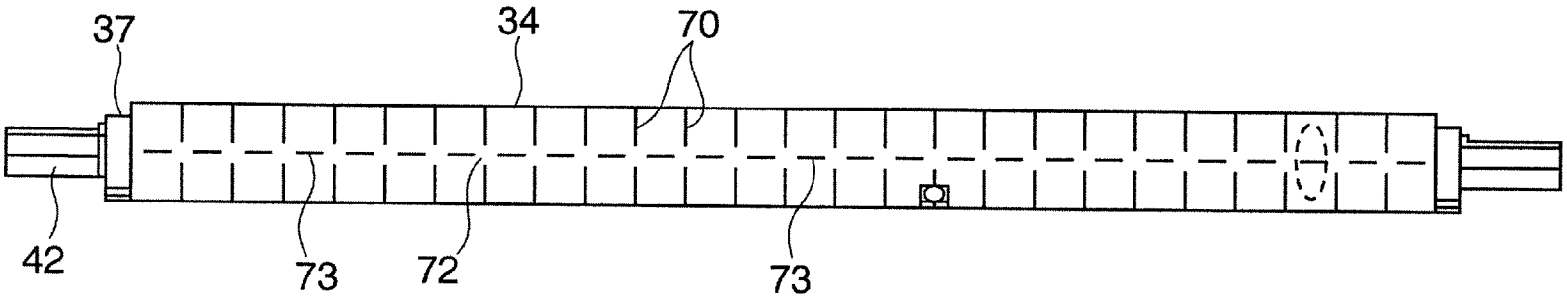

FIGS. 16A and 16B show heat generation control members according to a second exemplary embodiment of the invention. Portions having the same portions in the first exemplary embodiment will be given the same reference symbols as the latter. In the second exemplary embodiment, the continuous portion of the magnetic path forming member is provided with interrupting portions for interrupting eddy current that is caused in the heat generation control member through electromagnetic induction by the alternative magnetic field generating unit.

More specifically, in the second exemplary embodiment, as shown in FIG. 16A, plural slits 73 (interrupting portions) for interrupting eddy current that is caused in the heat generation control member 34 through electromagnetic induction by the alternative magnetic field generating device 33 are formed in the continuous portion 72 of the heat generation control member 34. The divisional slits 73 having a predetermined length are arranged in the longitudinal direction of the heat generation control member 34.

In the example of FIG. 16A, the slits 73 are formed at the same positions as the respective pairs of slits 70 so as to cross the slits 70. Alternatively, as shown in 16B, the slits 73 may be formed at different positions than the respective pairs of slits 70 so as to cross the slits 70.

Forming the slits 73 in the continuous portion 72 of the heat generation control member 34 in the above-described manner makes it possible to interrupt eddy current occurring in the continuous portion 72 and to thereby finely control the heat generation action of the heat generation control member 34.

The heat generation action of the heat generation control member 34 can be controlled more finely by setting the length and the interval of the slits 73 properly.

The other part of the configuration and the other actions will not be described because they are the same as in the first exemplary embodiment.

Exemplary Embodiment 3

Figure 17:
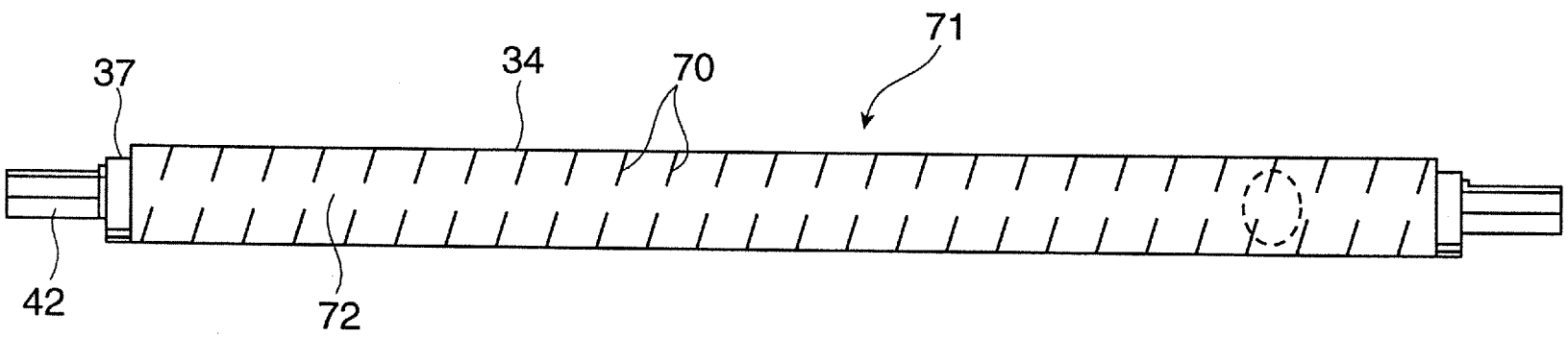
FIG. 17 is a plan view showing the structure of a heat generation control member according to a third exemplary embodiment of the invention.

FIG. 17 shows a heat generation control member according to a third exemplary embodiment of the invention. Portions having the same portions in the first exemplary embodiment will be given the same reference symbols as the latter. In the third exemplary embodiment, the interrupting portions of the magnetic path forming member are formed in the heat generation control member so as to be inclined from the axial direction of the heating rotary body.

More specifically, in the third exemplary embodiment, as shown in FIG. 17, plural slits 70 (interrupting portions) for interrupting eddy current that is caused in the heat generation control member 34 through electromagnetic induction by the alternative magnetic field generating device 33 are formed in the heat generation control member 34 so as to be inclined from its longitudinal direction, that is, so as to form a predetermined angle with the longitudinal direction.

Forming the plural slits 70 in such a manner that they form the predetermined angle with the longitudinal direction of the heat generation control member 34 makes it possible to permit a certain degree of heat transfer in the longitudinal direction of the heat generation control member 34 in cooperation with the continuous portion 72 and to thereby effectively suppress temperature increase around the ends of the sheet feed portion Fs of the fixing belt 31.

The other part of the configuration and the other actions will not be described because they are the same as in the first exemplary embodiment.

Exemplary Embodiment 4

Figure 20A:
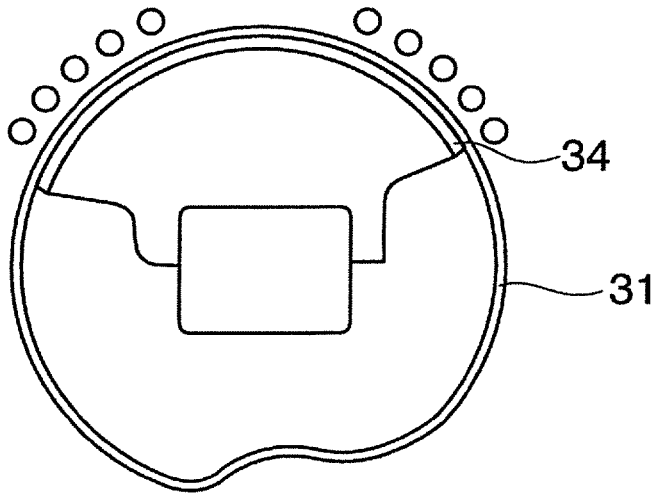
FIGS. 20A and 20B show the configuration of a fixing device according to a fourth exemplary embodiment of the invention.
Figure 20B:
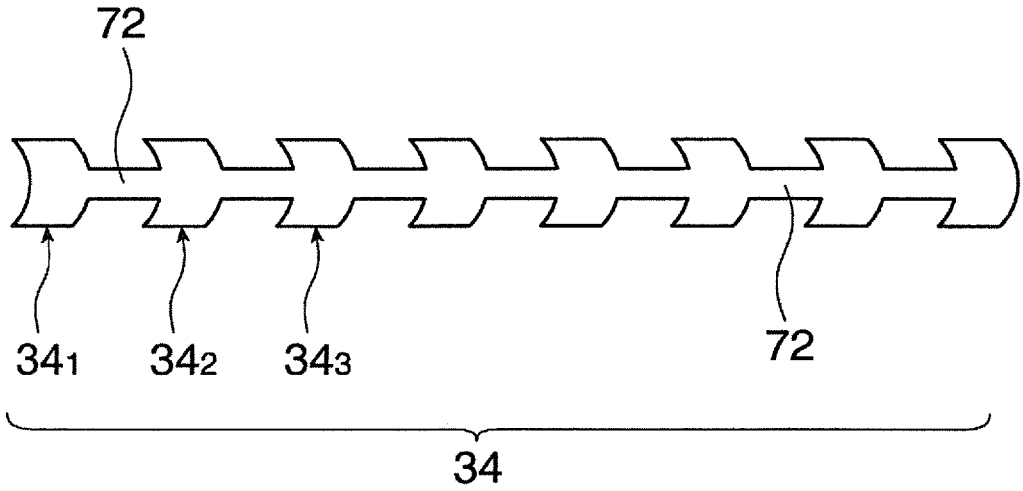

FIGS. 20A and 20B show a fixing device according to a fourth exemplary embodiment. Members having the same members in the first exemplary embodiment will be given the same reference symbols as the latter. The fixing device according to the fourth exemplary embodiment is equipped with a heat generation body for generating heat through electromagnetic induction; a heating rotary body which receives heat from the heat generation body and rotates about an axis while heating another member; a magnetic field generating unit disposed so as to be opposed to the heating rotary body, for generating a magnetic field for heating the heat generation body through electromagnetic induction; plural magnetic path forming member disposed so as to be opposed to the heating rotary body and the magnetic field generating unit, for forming magnetic paths; and a continuous portion which connects the plural magnetic path forming member in the direction of the axis.

More specifically, in the fourth exemplary embodiment, as shown in FIG. 20A, the heat generation control member 34 is disposed so as to be in contact with the inner surface of the fixing belt 31. In this exemplary embodiment, the heat generation control member 34 made of an Fe—Ni alloy and its thickness is set at 300 μm which is greater than the thickness 50 μm of the base layer 311 of the fixing belt 31. In the exemplary embodiment, since the heat generation control member 34 is in contact with the fixing belt 31, an allowable level of self-heat-generation of the heat generation control member 34 is higher than in the above embodiments. The reason why the thickness of the heat generation control member 34 is set at 300 μm is that forming a thin heat generation control member 34 is costly.

In the fourth exemplary embodiment, as shown in FIG. 20B, plural magnetic path forming members $\mathbf{34}_1$, $\mathbf{34}_2$, $\mathbf{34}_3$, . . . are disposed so as to be opposed to the fixing belt 31 and the magnetically exciting coil 56 and form magnetic paths. And a continuous portion 72 connects the plural magnetic path forming members $\mathbf{34}_1$, $\mathbf{34}_2$, $\mathbf{34}_3$, . . . in the axial direction.

The other part of the configuration and the other actions will not be described because they are the same as in the first exemplary embodiment.

Exemplary Embodiment 5

Figure 21:
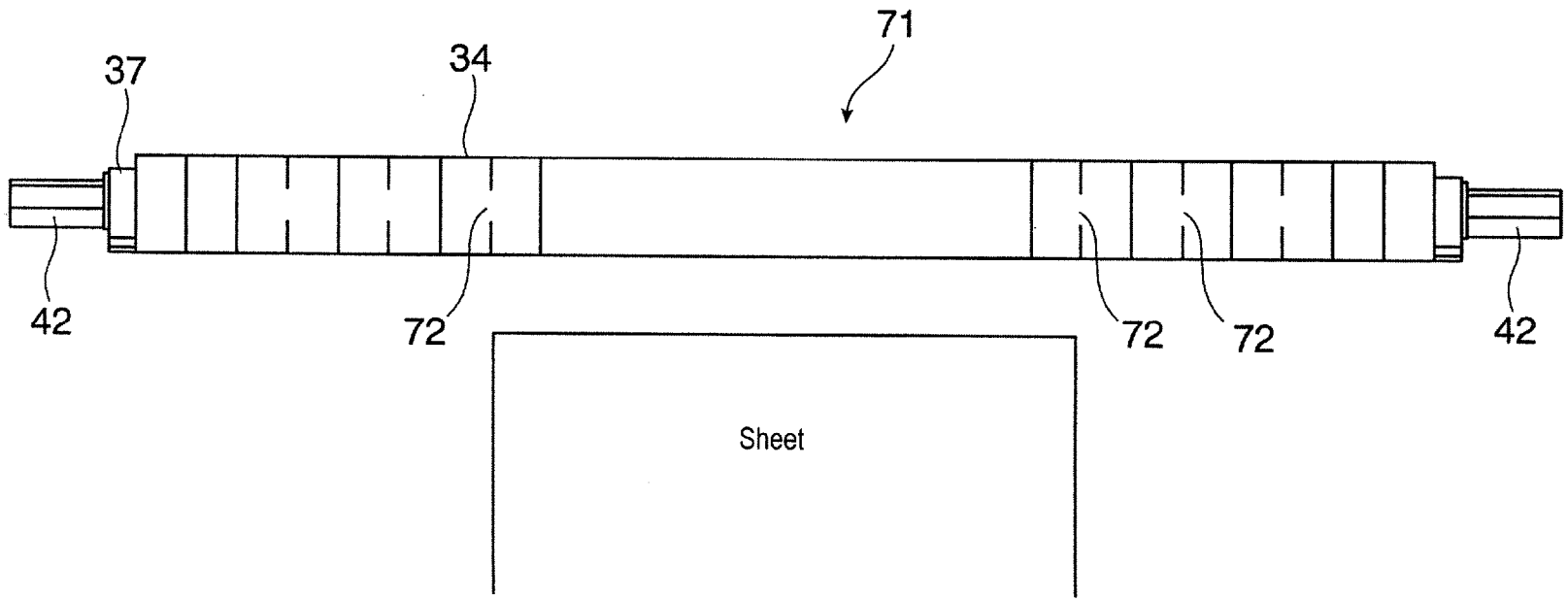
FIG. 21 is a plan view showing the structure of a heat generation control member according to a fifth exemplary embodiment of the invention.

FIG. 21 shows a heat generation control member according to a fifth exemplary embodiment of the invention. Portions having the same portions in the first exemplary embodiment will be given the same reference symbols as the latter. In the fifth exemplary embodiment, the continuous portion(s) is formed in a portion(s) that correspond to an end portion(s) of a heating subject member to be heated by the heating rotary body.

More specifically, in the fifth exemplary embodiment, as shown in FIG. 21, the continuous portion 72 is not formed over the entire length of the heat generation control member 34 and the continuous portion(s) 72 is formed in that portion (or those portions) of the heat generation control member 34 which correspond to an end portion(s) (both end portions or one end portion in the case where a recording sheet 21 is conveyed with the other end portion used as a reference) of a recording sheet 21 to be conveyed.

The other part of the configuration and the other actions will not be described because they are the same as in the first exemplary embodiment.

Exemplary Embodiment 6

Figure 22:
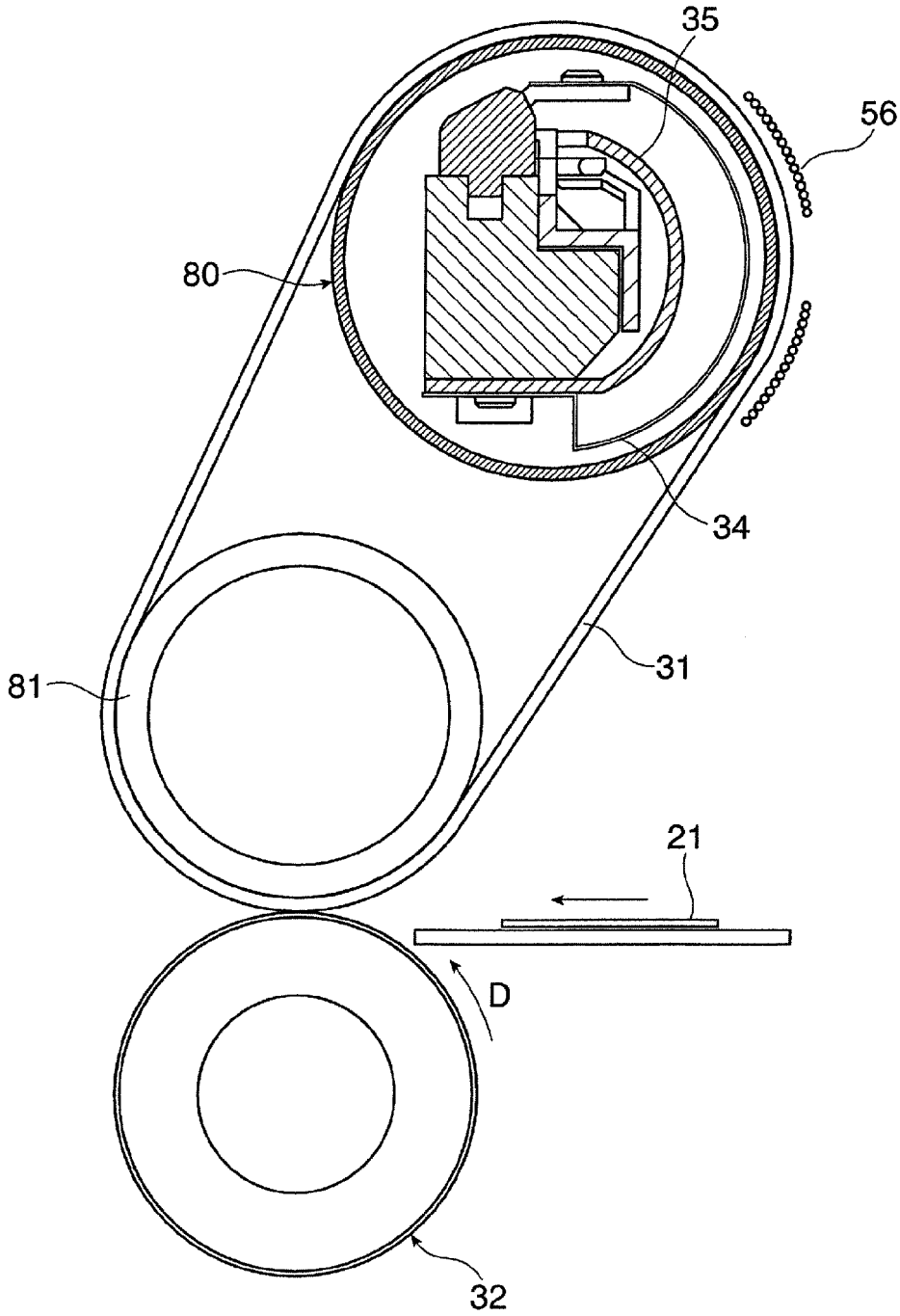
FIG. 22 shows the configuration of a fixing device according to a sixth exemplary embodiment of the invention.

FIG. 22 shows a fixing device according to a sixth exemplary embodiment. Members having the same members in the first exemplary embodiment will be given the same reference symbols as the latter. In the sixth exemplary embodiment, the heating rotary body and the heat generation body are separate bodies.

More specifically, in the sixth exemplary embodiment, as shown in FIG. 22, a heat generation roll 80 is provided as the heat generation body and a fixing belt 31 as the heating rotary body is stretched between the heat generation roll 80 and another roll 81. The fixing belt 31 is not provided with a heat generation body. The heat generation control member 34 is disposed inside the heat generation roll 80 and the magnetic exciting coil 56 (magnetic field generating unit) is disposed alongside the outer circumferential surface of the heat generation roll 80.

As described above, the heat generation need not always be provided with the heat generation body; they may be provided separately from each other.

The other part of the configuration and the other actions will not be described because they are the same as in the first exemplary embodiment.

The invention is applied to fixing devices of electrophotographic image forming apparatus such as printers and copiers. However, the application fields of the invention are not limited to that field and the invention can broadly be applied to general electromagnetic induction heating devices. For example, the invention can be applied to an electromagnetic induction heating device which performs welding by rotating another member using a heating rotary body which is heated to a predetermined temperature and heating a film member or the like to a predetermined temperature.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electromagnetic induction heating device comprising:

a heat generation body that generates heat through electromagnetic induction;

a heating rotary body that receives the heat from the heat generation body and rotates;

a magnetic field generating unit that is disposed so as to be opposed to the heating rotary body and that generates a magnetic field for causing the heat generation body to produce heat through the electromagnetic induction; and a magnetic path forming member that is disposed so as to be opposed to the magnetic field generating unit across the heating rotary body and that is made of a temperature-sensitive magnetic material, and wherein the magnetic path forming member is disposed inside the heating rotary body so as not to be in contact with the heating rotary body, the magnetic path forming member includes controlling portions that control a magnitude of eddy current which is generated through the electromagnetic induction caused by the magnetic field generating unit, and a continuous portion that allows heat transfer between regions divided by the controlling portions along a direction of an axis of the heating rotary body, and the continuous portion is opposed to an aperture portion or an end portion of the magnetic field generating unit, the continuous portion and the controlling portions are arranged in a circumferential direction of the heating rotary body.

2. The electromagnetic induction heating device according to claim 1, wherein each control portion includes a recess or a slit portion.

3. The electromagnetic induction heating device according to claim 1, wherein the controlling portions are formed so as to be inclined in the direction of the axis of the heating rotary body.

4. The electromagnetic induction heating device according to claim 1, wherein the continuous portion is continuous portions which are provided in portions that correspond to both end portions of a heating subject member to be heated by the heating rotary body.

5. The electromagnetic induction heating device according to claim 1, wherein the continuous portion has a predetermined width in the direction of the axis of the heating rotary body.

6. The electromagnetic induction heating device according to claim 1, wherein the heat generation body and the heating rotary body are integrated.

7. A fixing device comprising:

the electromagnetic induction heating device according to claims 1; and a pressure application body that presses a recording medium which holds a toner image and is passing through a pressure contact region where the pressure application body is pressed against the heating rotary body.

8. The fixing device according to claim 7, wherein each control portion includes a recess or a space portion.

9. The fixing device according to claim 7, wherein the weak part of the magnetic field generated by the magnetic field generating unit is opposed to an aperture portion or an end portion of the magnetic field generating unit.

10. An image forming apparatus comprising:

an image forming unit that forms a toner image on an image carrying body;

a transfer unit that transfers the toner image, which has been formed on the image carrying body by the image forming unit, onto a recording medium directly or via an intermediate transfer body; and the fixing device according to claim 7 which fixes, onto the recording medium, the toner image transferred to the recording medium.

11. The image forming apparatus according to claim 10, wherein each control portion includes a recess or a slit portion.

12. An electromagnetic induction heating device comprising:

a heat generation body that generates heat through electromagnetic induction;

a heating rotary body that receives the heat from the heat generation body and rotates;

a magnetic field generating unit that is disposed so as to be opposed to the heating rotary body and that generates a magnetic field for causing the heat generation body to produce heat through the electromagnetic induction; and a magnetic path forming member that is disposed so as to be opposed to the magnetic field generating unit across the heating rotary body and that is made of a temperature-sensitive magnetic material, and wherein the magnetic path forming member is disposed inside the heating rotary body so as not to be in contact with the heating rotary body, the magnetic path forming member includes controlling portions that control a magnitude of eddy current which is generated through the electromagnetic induction caused by the magnetic field generating unit, and a continuous portion that allows heat transfer between regions divided by the controlling portions along a direction of an axis of the heating rotary body, and the continuous portion is located in a weak part of the magnetic field generated by the magnetic field generating unit, the continuous portion and the controlling portions are arranged in a circumferential direction of the heating rotary body.

13. The electromagnetic induction heating device according to claim 12, wherein each control portion includes a recess or a slit portion.

14. The electromagnetic induction heating device according to claim 12, wherein the weak part of the magnetic field generated by the magnetic field generating unit is opposed to an aperture portion or an end portion of the magnetic field generating unit.

15. The electromagnetic induction heating device according to claim 12, wherein the controlling portions are formed so as to be inclined in the direction of the axis of the heating rotary body.

16. The electromagnetic induction heating device according to claim 12, wherein the continuous portion is continuous portions which are provided in portions that correspond to both end portions of a heating subject member to be heated by the heating rotary body.

17. The electromagnetic induction heating device according to claim 12, wherein the continuous portion has a predetermined width in the direction of the axis of the heating rotary body.

18. The electromagnetic induction heating device according to claim 12, wherein the heat generation body and the heating rotary body are integrated.

19. An electromagnetic induction heating device comprising:

a heat generation body that generates heat through electromagnetic induction;

a heating rotary body that receives the heat from the heat generation body and rotates;

a magnetic field generating unit that is disposed so as to be opposed to the heating rotary body and that generates a magnetic field for causing the heat generation body to produce heat through the electromagnetic induction; and a magnetic path forming member that is disposed so as to be opposed to the magnetic field generating unit across the heating rotary body and that is made of a temperature-sensitive magnetic material, wherein the magnetic path forming member includes:

an interrupting portion that is formed of a plurality of slit portions each of which is provided to intersect with a direction of an axis of the heating rotary body so as to interrupt an eddy current in the magnetic path forming member which is generated through the electromagnetic induction caused by the magnetic field generating unit, and a continuous portion that is provided in a part of the interrupting portion, wherein the continuous portion is continuing along the direction of the axis of the heating rotary body and allows heat transfer between regions divided by the plurality of slit portions of the interrupting portion along a longitudinal direction of the heating rotary body, the continuous portion and the slit portions are arranged in a circumferential direction of the heating rotary body.

* * * * *